US006557980B1

(12) United States Patent
Ito et al.

(10) Patent No.: US 6,557,980 B1
(45) Date of Patent: May 6, 2003

(54) IMAGE FORMING DEVICE, AND ITS MANUFACTURING METHOD AND APPARATUS

(75) Inventors: Taichi Ito, Hirakata (JP); Takuya Kitahara, Hirakata (JP); Hidenori Tomachi, Fujisawa (JP); Akira Kumon, Katano (JP); Katsutoshi Ogawa, Hirakata (JP); Yoshitaka Kitaoka, Osaka (JP); Takahiro Tsujimoto, Moriguchi (JP); Akira Fukano, Ikoma (JP); Masayoshi Miura, Kawasaki (JP); Akira Ryoji, Osaka (JP); Masaichiro Tatekawa, Minoo (JP)

(73) Assignees: Matsushita Electric Industrial Co., Ltd., Osaka (JP); Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/890,322

(22) PCT Filed: Jan. 28, 2000

(86) PCT No.: PCT/JP00/00506

§ 371 (c)(1),
(2), (4) Date: Nov. 6, 2001

(87) PCT Pub. No.: WO00/44566

PCT Pub. Date: Aug. 3, 2000

(30) Foreign Application Priority Data

| | | |
|---|---|---|
| Jan. 28, 1999 | (JP) | 11-020366 |
| May 19, 1999 | (JP) | 11-138228 |
| May 19, 1999 | (JP) | 11-138229 |

(51) Int. Cl.[7] ..... B41J 2/06

(52) U.S. Cl. ..... 347/55

(58) Field of Search ..... 347/55, 151, 120, 347/141, 154, 163, 123, 111, 159, 127, 128, 131, 125, 158; 399/271, 290, 292, 293, 294, 295

(56) References Cited

U.S. PATENT DOCUMENTS

| | | | |
|---|---|---|---|
| 3,689,935 | A | 9/1972 | Pressman et al. |
| 5,296,879 | A | 3/1994 | Kagayama |
| 5,374,949 | A | 12/1994 | Wada et al. |
| 5,477,250 | A | 12/1995 | Larson |
| 5,495,273 | A | 2/1996 | Kitamura |
| 5,559,544 | A | 9/1996 | Sato |
| 5,640,185 | A | 6/1997 | Kagayama |
| 5,850,244 | A | 12/1998 | Leonard et al. |

FOREIGN PATENT DOCUMENTS

| | | |
|---|---|---|
| JP | 44-26333 | 11/1969 |
| JP | 3-057658 | 3/1991 |
| JP | 4-164659 | 6/1992 |
| JP | 4-166348 | 6/1992 |

(List continued on next page.)

*Primary Examiner*—Raquel Yvette Gordon
(74) *Attorney, Agent, or Firm*—Jordan and Hamburg LLP

(57) ABSTRACT

An image forming apparatus has a toner carrier and a toner passing control having a plurality of toner passing holes for controlling passage of a toner. The toner passing control has upstream side secured, the downstream side extended by a spring, and is contacted with a stay on the downstream side of the contact point with the toner carrier, so that corrugation deformation is prevented. A vibrating plate and an ultrasonic vibration generator are coupled through a coupling portion, thereby relative displacement between the vibrating plate and the ultrasonic vibration generator is allowed. A detachable toner cartridge is formed by integrating a developing roller and a toner storing container.

36 Claims, 21 Drawing Sheets

FOREIGN PATENT DOCUMENTS

| | | |
|---|---|---|
| JP | 4-182151 | 6/1992 |
| JP | 5-077479 | 3/1993 |
| JP | 5-2861666 | 11/1993 |
| JP | 6-127014 | 5/1994 |
| JP | 6-222664 | 8/1994 |
| JP | 6-262796 | 9/1994 |
| JP | 7-052442 | 2/1995 |
| JP | 7-227997 | 8/1995 |
| JP | 8-108565 | 4/1996 |
| JP | 8-118706 | 5/1996 |
| JP | 8-164626 | 6/1996 |
| JP | 9-500842 | 1/1997 |
| JP | 9-030029 | 2/1997 |
| JP | 9-039289 | 2/1997 |
| JP | 9-277583 | 10/1997 |
| JP | 10-067133 | 3/1998 |
| JP | 10-100780 | 4/1998 |
| JP | 10-151789 | 6/1998 |
| WO | WO95/24675 | 9/1995 |

IMAGE FORMING DEVICE, AND ITS MANUFACTURING METHOD AND APPARATUS

TECHNICAL FIELD

The present invention relates to an image forming apparatus applied to a copying machine, a facsimile, a printer and the like, and more particularly, to an image forming apparatus controlling a toner flying from a toner carrier to a back surface electrode using toner passing control means controlled in response to an image signal, and applying the toner to image receiving means positioned between the toner passing control means and the back surface electrode, thereby forming images.

BACKGROUND ART

In recent years, with the improvements in the performance of personal computers and the development of the network technology, there has been a strong demand for printers or copiers having processing capability high enough for printing a large amount of documents and also color documents. However, such image forming apparatuses capable of outputting high quality monochrome or color documents at a satisfactory level and a high processing speed are much in demand and yet still under development.

As one such technique, an image forming technique according to so-called "toner jet (registered trademark)" method is known. According to the method, a toner is let to fly onto image receiving means such as recording paper and an image carrying belt by the effect of an electric field for forming images.

The apparatuses disclosed by Japanese Patent Publication No. 44-26333, U.S. Pat. No. 3,689,935 (see Japanese Patent Publication No. 60-20747), and Japanese Patent Republication No. 9-500842 are known as the image forming apparatuses of this kind. The apparatus disclosed by Japanese Patent Application No. 10-100780 will be now described in conjunction with FIG. 6 by way of illustration.

In FIG. 6, a grounded toner carrier 31 carries and transports a charged toner, while a restriction blade 32 controls the toner on the toner carrier 31 into one to three layers and charges the toner. A supply roller 33 supplies the toner to the toner carrier 31 and charges the toner. Toner passing control means 34 is provided with a toner passing hole 35 around which a control electrode 36 is provided. A voltage corresponding to an image signal is applied to the control electrode 36 from a control power supply 37. Reference numeral 38 denotes a back surface electrode and 39 denotes a back surface electrode power supply. Reference numeral 40 denotes image receiving means such as recording paper transported on the back surface electrode 38.

In the above-described structure, as the supply roller 33 and the toner carrier 31 are operated to form an even toner layer on the toner carrier 31 with the restriction blade 32 and the toner layer is transported, a voltage is applied to the back surface electrode 38. Meanwhile, the image receiving means 40 is moved, and a voltage corresponding to an image signal is applied by the control power supply 37 such as a driving IC to the control electrode 36 in synchronization with the movement, so that the toner on the toner carrier 31 is allowed to pass the toner passing hole 35 and fly in response to the image signal and stick on the image receiving means 40. Thus, a desired image is formed on the image receiving means 40.

In order to form a fine image of 600 dpi (dots per inch) on the entire surface of the image receiving means 40, for example, the toner passing control means 34 must be provided with the toner passing holes 35 at such a pitch. Meanwhile, the holes inevitably cannot be arranged in a single row, and therefore as shown in FIG. 8, the toner passing holes 35 and the control electrodes 36 are arranged in a plurality of rows (eight rows in the figure). The toner passing hole 35 and the control electrode 36 are circular, and connection electrodes electrically connected to the control electrodes 36 are provided to extend on both sides in the moving direction of the toner carrier 31 in order to prevent mutual interference, and each connected to a lead in the driving IC outputting the control voltage.

Note that in FIG. 6, as an example of the constitution, the image receiving means 40 is composed of recording paper or the like, and an image is formed directly thereon, while the recording paper could vary in thickness, easily change in the property depending on the humidity, and easily deform during the transportation. In case of a color printer, the varying transportation of the recording paper makes it difficult to achieve synchronization in the timing of forming an image in each color, which could cause problems such as degradation in the image quality. Therefore, as disclosed by Japanese Patent Application No. 10-100780, an intermediate image carrying belt may preferably be used as the image receiving means 40 and the image formed on the image carrying belt may be transferred altogether onto recording paper in some cases.

The constitution above is now described in conjunction with FIG. 7. Reference numeral 43 denotes an endless type image carrying belt as the image receiving means 40, and the belt is made of a film produced by scattering a conductive filler within resin and having a resistance of about $10^{10}$ Ù·cm, and wound around between a pair of rollers 44*a* and 44*b*. A pickup roller 45 feeds a recording paper sheet 46 on a one-sheet-basis from a paper feed tray, a timing roller 47 synchronizes the fed recording paper sheet 46 and the image position, and a transfer roller 48 transfers a toner image formed on the image carrying belt 43 onto the recording paper sheet 46. The transfer roller is pressed toward the roller 44*a* with the image carrying belt 43 interposed therebetween and applied with a transfer voltage. A fixing device 49 heats and presses the recording paper sheet 46 having the toner image transferred thereon for fixing the toner image on the recording paper sheet 46.

With the image forming apparatus of this kind, in order to form dots about as small as 100 $\mu$m, for example, the small holes in the print head must be about as small as 100 $\mu$m, so that the small holes could clogged up and resultant dots could be thinned or dots are not formed at all. This phenomenon occurs because in addition to the clogging of the small holes with dust scattered in the apparatus, the small holes may be clogged with a developer used for forming images as well. The deposited developer or foreign substances affect an electric field formed by the control electrode, or mechanically prevents the developer from passing, so that resultant dots are thinned or dots are not formed at all. Therefore, some cleaning means is necessary for the print head.

As conventional means for cleaning the small holes, there are a method of using an electric field or an air flow as well as a method of providing ultrasonic vibration to the print head which allows effective cleaning of a developer which is not charged or a developer solidified within the small holes for example as suggested by Japanese Patent Publication No. 3-57658.

According to the disclosure of Japanese Patent Publications No. 4-164659 and No. 5-77479, a developer passing control member having small holes and control electrodes is attached with a vibration generator providing vibration and the vibration forms an advancing wave propagating the developer passing control member so that all the small holes can evenly be cleaned. For the purpose, a vibrating member is secured along the row of small holes in the developer passing control member and a vibration generator is coupled to one end of the vibrating member.

Another conventional image forming apparatus employs a direct marking method according to which an image is directly formed on a recording member. An image forming apparatus disclosed by Japanese Patent Publication No. 44-26333 is a developer injection type apparatus according to one of such direct marking methods. According to the direct marking method, an image signal is input to a control electrode provided at a print head to cause an accelerated electric field, a charged developer is allowed to pass a small hole near the control electrode, and the developer is allowed to land on the recording member by a voltage applied to counter electrodes, so that an image is formed.

As an image forming apparatus of this kind, Japanese Patent Publication No. 9-30029 discloses an apparatus having a print head in which developer passing control means controlling passage of a developer through small holes is integrally secured to a supporting member and a driving IC for driving control electrodes is integrally provided to the developer passing control means.

According to the disclosure of Japanese Patent Publication No. 9-277583, one end of developer passing control means is secured to a developer storage container including developer carrying means, and the other end is attached as it is extended by an elastic member, so that the developer passing control means is integrally provided to a developer supply unit and the whole structure is detachably provided to the main body.

Meanwhile, in the image forming apparatuses having the above-described structures, the distance between the toner carrier 31 and the toner passing control means 34, in other words the distance between the toner carrier 31 and the control electrode 36 greatly affects the amount of the toner passed through the toner passing holes 35. Therefore, according to the disclosure of the Japanese Patent Republication No. 9-500842, for example, a scraper blade is provided between the toner carrier 31 and the toner passing control means 34 to maintain the distance. However, the toner layer on the toner carrier 31 is disturbed by a change in the contact pressure between the toner carrier 31 and the toner passing control means 34 caused by the eccentricity of the axial center of rotation of the toner carrier 31. Therefore, according to the disclosure of Japanese Patent Publication No. 8-118706, the toner passing control means 34 is secured through elastic securing means. However, the fluctuation of the toner passing control means 34 generated by the friction force at the contact point between the toner passing control means 34 and the moving toner carrier 31 causes the positional change of the toner passing hole 35, which disturbs the flying of the toner passed through the toner passing hole 35 and degrades the image quality.

Also, the toner passing control means 34 is made of several materials of different kinds, and therefore the tension corrugates the surface, and the distance between the toner carrier 31 and the toner passing control means 34 is unequal in the direction of the row of the toner passing holes, which degrades the image quality.

Besides, the toner passing control means 34 and the image receiving means 40 are positioned in the proximity at a distance in the range from 100 $\mu$m to 500 $\mu$m. Therefore, the toner on the toner carrier 31 passed through the toner passing hole 35 at the toner passing control means 34 in response to an image signal flies and sticks on the image receiving means 40 and then the toner returns from the image receiving means 40 to stick on the surface of the toner passing control means 34 and fall on the image, which degrades the image quality.

In addition, in the image forming apparatus having the above-described structure, the relative positions of the developer passing control member, and the vibrating member, and vibration generator must be fixedly set. Meanwhile, the gap between the developer carrying means supplying the developer to the small holes of the developer passing control member and the developer passing control member must be restricted highly precisely, or otherwise the magnitude of the accelerated electric field of the developer greatly varies, and high quality images cannot be formed. Therefore, the mutual positions of the developer carrying means and the developer passing control member at the time of the mounting operation of the developer carrying means and at the time of the axis fluctuation during the operation of the developer passing control member must be automatically adjusted. If the position of the developer passing control member is delicately adjusted in abutment against the developer carrying means, the rigidly provided vibration generator causes its relative position to the vibrating member on the developer passing control member to be incorrect, which impedes appropriate vibration propagation. As a result, the cleaning performance could not be achieved stably or correct images could not be formed by the distortion of the developer passing control member.

According to the disclosure of Japanese Patent Publication No. 9-30029, in order to maintain the attachment tolerance for the print head and the developer carrying means for forming high quality images highly precisely, they should be assembled integrally, which impedes simple supplement of the developer, in other words the device could be difficult to handle or maintain. If the integrated whole must be exchanged, the cost would increase, and the manufacturing and assembling could be complicated and the cost thereof could also increase.

According to the disclosure of the Japanese Patent Publication No. 9-277583, the developer supply unit having integrally formed developer passing control means needs only be exchanged and therefore the apparatus is easier to handle, but the high precision developer passing control means is included in the exchange unit, which pushes up the cost. Recycling of the exchange unit must be performed highly carefully, which eventually increases the cost.

The present invention is directed to the above-described conventional problems, and it is an object of the present invention to provide an image forming apparatus capable of forming high quality images by preventing the positional fluctuation of the toner passing holes, the corrugation of the toner passing control means, and toner flying and sticking to the image receiving means from returning from the image receiving means to stick and be deposited on the surface of the toner passing control means.

Furthermore, the present invention is directed to the above-described conventional problems, and it is another object of the present invention to provide an image forming apparatus capable of stably achieving cleaning performance according to a cleaning method by ultrasonic vibration and forming high quality images.

Still furthermore, the present invention is directed to the above-described conventional problems, and it is an object of the present invention to provide a low cost and easy-to-handle image forming apparatus which can form high quality images, can be easy to be maintained, and can be manufactured with high productivity, and to provide a manufacturing method and a manufacturing device therefor.

DISCLOSURE OF THE INVENTION

The first aspect of an image forming apparatus according to the present invention includes a toner carrier moving while carrying a charged toner, toner passing control means having a plurality of toner passing holes through which the toner passes and applying an image signal to a control electrode provided to surround the holes, thereby controlling passage of the toner, image receiving means to which the passed toner sticks, and a back surface electrode provided at the back surface of the image receiving means for drawing the toner. The toner passing control means is secured on the upstream side of the contact point with the toner carrier in the moving direction of the toner carrier, and is secured on the downstream side in the moving direction of the toner carrier through an elastic member. The upstream side is secured, so that the fluctuation of the toner passing control means caused by the friction force at the contact point between the toner passing control means and the moving toner carrier can be prevented, the positional fluctuation of the toner passing holes can be prevented and high quality images can be formed.

The second aspect of an image forming apparatus according to the present invention includes a toner carrier moving while carrying a charged toner, toner passing control means having a plurality of toner passing holes through which the toner passes and applying an image signal to a control electrode provided to surround the holes, thereby controlling passage of the toner, image receiving means to which the passed toner sticks, and a back surface electrode provided at the back surface of the image receiving means for drawing the toner. The toner passing control means is in contact with a stay extending in a direction perpendicular to the moving direction of the toner carrier on the downstream side of the contact point with the toner carrier in the moving direction of the toner carrier. The toner passing control means is contacted with the stay on the downstream side of the contact point with the toner carrier in the moving direction of the toner carrier, so that the corrugation deformation of the toner passing control means caused by applied tension can be prevented, the distance between the toner carrier and the toner passing control means can be constant in the direction of a toner passing hole row, which equalizes the toner amount passed through the toner passing holes, and high quality images can be formed.

The third aspect of an image forming apparatus according to the present invention includes a toner carrier moving while carrying a charged toner, toner passing control means having a plurality of toner passing holes through which the toner passes and applying an image signal to a control electrode provided to surround the holes, thereby controlling passage of the toner, image receiving means to which the passed toner sticks, and a back surface electrode provided at the back surface of the image receiving means for drawing the toner. The toner passing holes are contacted with the toner carrier through spacer means provided in a position on the toner passing control means on the upstream side of the toner passing holes in the moving direction of the toner carrier, the toner passing control means is contacted to a stay extending in a direction perpendicular to the moving direction of the toner carrier on the downstream side of the contact point with the toner carrier in the moving direction of the toner carrier.

Thus, the toner passing control means is contacted with the stay on the downstream side of the contact point with the toner carrier in the moving direction of the toner carrier, so that the corrugation deformation of the toner passing control means caused by tension applied upon the toner passing control means can be prevented. The spacer can be pressed evenly over to the toner carrier entirely in the direction of the toner passing hole row, so that generation of a space between the spacer and the toner carrier can be prevented, and the gap between the toner carrier and the toner passing control means can be constant and as thick as the spacer in the direction of the toner passing holes. Accordingly, the toner amount passing through each toner passing hole is equalized, and high quality images can be formed.

The fourth aspect of an image forming apparatus according to the present invention includes a toner carrier moving while carrying a charged toner, toner passing control means having a plurality of toner passing holes through which the toner passes and applying an image signal to a control electrode provided to surround the holes, thereby controlling passage of the toner, image receiving means to which the passed toner sticks, and a back surface placed provided at the back surface of the image receiving means for drawing the toner. There is a gap portion between the toner passing control means and the image receiving means gradually expanding toward the downstream side of the image receiving means from the toner passing holes. The toner from the toner carrier passed through the toner passing holes in the toner passing control means in response to an image signal and flying to arrive on the image receiving means can be prevented from returning from the image receiving means to the toner passing control means, so that spotless, high quality images can be formed.

Also, an image forming apparatus according to the present invention includes developer carrying means for carrying and transporting a charged developer, developer passing control means having a base member provided with a row of a plurality of small holes formed in the direction perpendicular to the direction of transporting the developer through which the developer passes and controlling passage of the developer through the small holes in response to an externally applied image signal, and image receiving means to which the developer passed through the small holes sticks. In the apparatus, a vibrating member is rigidly attached to a side portion of the base member of the developer passing control means in the arranging direction of the small holes, and ultrasonic vibration generating means for generating ultrasonic vibration is provided, and the ultrasonic vibration generating means and the vibrating member are coupled by coupling means allowing relative displacement between them and transmitting ultrasonic vibration.

Thus, ultrasonic vibration can be transmitted through the coupling means allowing relative displacement of the vibrating member secured to the base member of the developer passing control means and the ultrasonic vibration generating means, and the ultrasonic vibration can be transmitted if there is any fluctuation of the developer passing control means, so that stable cleaning performance as well as stable image formation can be achieved. Meanwhile, there is little possibility of distortion generated in the developer passing control means and therefore high quality images can be formed.

More specifically, the vibrating member may be provided with a coupling portion integrally extending toward the ultrasonic vibration generating means at one end, the coupling portion may have its tip end secured to the ultrasonic vibration generating means and a width-reduced portion may be provided in the coupling portion. Alternatively, a bent portion or a U-shaped portion may be provided in the coupling portion. As a result, the ultrasonic vibration can be transmitted while relative displacement is allowed in a simple structure.

The vibrating member may be rigidly attached to a side of the base member of the developer passing control means in the arranging direction of the small holes, ultrasonic vibration generating means for generating ultrasonic vibration may be provided, the vibrating member and the ultrasonic vibration generating means may be rigidly coupled and the ultrasonic vibration generating means may be supported in a displaceable manner. In this manner, the same function and effects can still be provided.

In particular, the developer passing control means has one end of the base member on the upstream side in the developer transporting direction, and the other end coupled to extension means, and the developer carrying means and the developer passing control means are partly in direct or indirect contact to set a gap between them. Application of this structure to the above described structure allows high quality images to be surely formed and stable cleaning performance can be achieved.

Conversely, the developer passing control means has one end of the base member secured on the downstream side in the transporting direction of the developer and the other end coupled to extension means, and the developer carrying means and the developer passing control means are partly in direct or indirect contact to set the gap between them. The above structure may be applied to provide similarly great effect.

The vibrating member is provided on the developer passing control means on the opposite side of a position where the developer carrying means and the developer passing control means are partly in direct or indirect contact in the direction of transporting the developer with reference to the small hole row. As a result, vibration by the vibrating member is surely transmitted to the small hole row in the developer passing control means, so that clogging can more surely be prevented. In this case, one end of the developer passing control means on the downstream side in the transporting direction of the developer is secured, and the vibrating member is provided between the secured end and the small hole row, so that the displacement of the vibrating member is reduced, and relative displacement of the ultrasonic vibration generating means and the vibrating member can readily be allowed. As a result, the above effects can surely be provided in a simple structure.

Also, the vibrating member is provided in a position on the downstream side of the arranging position of the small hole row in the developer passing control means in the direction of transporting the developer, and the base member of the developer passing control means is bent by the vibrating member. Then, the developer passing control means is bent and the member for preventing the corrugation can also serve as the vibrating member, so that the structure can be simplified while high cleaning performance can be achieved, and high quality images can be formed.

Further, the vibrating member is supported rotatably around the axial center, and the ultrasonic vibration generating means is supported pivotally around the axial center. As a result, the displacement of the developer passing control means can smoothly be absorbed by the rotation of the vibrating member, and ultrasonic vibration can be transmitted surely and effectively.

Besides, the vibrating member is rigidly attached to a side portion of the base member of the developer passing control means in the arranging direction of the small holes, while the vibrating member is supported rotatably around the axial center, and ultrasonic vibration generating means for generating ultrasonic vibration is provided. A coupling vibrating member rigidly coupled to the ultrasonic vibration generating means and the vibrating member are coupled in a relatively rotatable manner, so that the rotation of the vibrating member allows the displacement of the developer passing control means to be absorbed, and the ultrasonic vibration generating means can rigidly be provided. Therefore, the ultrasonic vibration generating means can be provided in a simple manner, while the displacement of the developer passing control means can smoothly be absorbed, and ultrasonic vibration can be transmitted surely and effectively.

Also in this structure, the developer passing control means has the base member having one end on the upstream side in the developer transporting direction secured and the other end coupled to extension means, and the base member of the developer passing control means is bent by the vibrating member. Thus, the structure may be simplified as described, while high cleaning performance can be achieved and high quality images can be formed.

In an image forming apparatus according to the present invention includes developer carrying means for carrying and transporting a charged developer, developer passing control means having a base member provided with a row of a plurality of small holes formed in the direction perpendicular to the direction of transporting the developer through which the developer passes and controlling passage of the developer through the small holes in response to an externally applied image signal, image receiving means to which the developer passed through the small holes sticks, and ultrasonic cleaning means for providing ultrasonic vibration to the developer passing control means, thereby cleaning the small holes, a seal blade is provided at a developer storing container wall or at a case wall storing a developer storing container, the seal blade has a tip end in contact with the inner surface in a position on the opposite side of a position where the developer carrying means and the developer passing control means are in direct or indirect contact in the direction of transporting the developer with reference to the small hole row in the developer passing control means. Thus, the developer passing control means is cleaned by applying ultrasonic vibration, while the vibration can prevent the developer from leaking to the outside along the inner surface of the developer passing control means.

An image forming apparatus according to the present invention includes developer carrying means for carrying and transporting a charged developer, developer passing control means having a base member provided with a row of a plurality of small holes through which the developer passes in the direction perpendicular to the direction of transporting the developer and controlling passage of the developer through the small holes in response to an externally applied image signal, image receiving means to which the developer passed through the small holes sticks, and a back surface electrode supporting the image receiving means and provided with a prescribed voltage for forming an electric field between the developer carrying means and itself to let the developer fly. The developer carrying means and a storing container storing a developer are integrated into a developer supply unit, and at least one end of the developer passing control means is positioned and secured to a box member having the detachably provided developer supply unit.

Thus, the developer passing control means can supplement a developer by removing the developer supply unit to the positioned and secured box member, which makes the apparatus easy to handle. The developer supply unit as a supply exchange part is not provided with the developer passing control means, which reduces the cost. The box member positions the developer supply unit and therefore high quality images can be formed.

One end of the developer passing control means is positioned and secured to the box member, and the other end of the developer passing control means is coupled to extension means. Thus, the developer passing control means may be displaced against the extension means for adjusting the position relative to the developer carrying means, the position of the small holes can be set precisely with reference to the one end, while the developer passing control means can be prevented from being loosened, and the developer passing control means can equally abut against the developer carrying means.

A guide shaft is provided to be projected at both ends of the developer supply unit, a guide groove with which the guide shaft engages when the developer supply unit inserted to the box member is provided, and the engagement of the guide shaft and the guide groove positions the small hole row in the developer passing control means and the developer carrying means in the plane direction perpendicular to the far-near direction of the axial center. By simply inserting the developer supply unit to the box member, the positioning in the plane direction can automatically be achieved.

The developer supply unit is provided with first spacer means for abutting against the back surface electrode and restricting the distance between the developer carrying means and the back surface electrode when the unit is mounted to the box member. In this structure, simply by inserting the developer supply unit to the box member and bringing the first spacer means into abutment against the back surface electrode, the gap between the developer carrying means and the back surface electrode can be highly precisely set to a prescribed distance.

Second spacer means is provided on the inner side of the developer passing control means, and said second spacer means abuts against the developer carrying means when the developer supply unit is mounted to the box member. The developer passing control means abuts through the second spacer means or directly against the developer carrying means when the developer supply unit is mounted to the box member, so that the developer passing control means is moved and the extension means is displaced. In this structure, simply by inserting the developer supply unit to the box member and bringing the developer carrying means into abutment against the second spacer means or the developer passing control means, the gap between the developer carrying means and the developer passing control means can be highly precisely set to a prescribed distance.

There may be provided means for pressing and urging the developer supply unit toward the back surface electrode and the developer passing control means as the developer supply unit is mounted. Thus, simply by mounting the developer supply unit, the distance between the developer carrying means and the back surface electrode, and the gap between the developer carrying means and the developer passing control means can be set highly precisely to a prescribed distance.

When the developer supply unit is mounted to the box member, the developer carrying means is in abutment in a position apart from a side edge of the upper surface of the second spacer means. Thus, developer carrying means can be prevented from colliding against the edge of the second spacer means and being damaged. The developer passing control means has one end detachably secured to the box member, so that the developer passing control means can readily be exchanged or maintained.

The developer supply unit has a protection cover for covering an exposed part of the developer carrying means when it is not mounted, so that the developer carrying means can surely be prevented from being damaged during the transportation of the developer supply unit.

The box member is detachably provided to a main body case. By removing the box member from the main body case, the maintenance of the developer passing control means such as exchange or cleaning or the maintenance of the back surface electrode or any intermediate belt used as image receiving means can be readily achieved.

The box member is provided with a mounting portion for a plurality of developer supply units and the developer passing control means parallel to each other, so that the developer passing control means and the developer supply unit can be positioned highly precisely parallel to each other by the single box member and high quality color images can be formed.

The developer passing control means can each be independently positioned, so that the small hole rows can be set highly precisely parallel to each other by individual adjustment of each developer passing control means. Misalignment among colors can surely be prevented and high quality color images can be formed and each developer passing control means can readily be exchanged and maintained.

When a plurality of developer supply units are mounted to the box member, the first spacer means provided to the developer supply unit abuts against the opposing back surface electrode, so that without the effect of fine distortion or curve in the box member if any, the distance between the developer carrying means and the back surface electrode can independently be restricted to the opposing back surface electrode highly precisely and stably for each developer supply unit. The recording conditions can be equalized for the plurality of developer supply units, and high quality color images in good color balance can be formed.

According to a method of manufacturing an image forming apparatus and a device therefor according to the present invention, the image forming apparatus includes developer carrying means and developer passing control means, a developer carrier is detachably mounted to a box member, one end of the developer passing control means is secured to the box member, and the other end is coupled to an extension member. The box member temporarily mounted with the developer passing control means is positioned and secured in a prescribed position, the developer carrying means or a dummy thereof is mounted in a prescribed position of the box member, and one end of the developer passing control means is held against the urging force of the extension member, while the position of the small hole row is recognize. The position of the small hole row is adjusted to be in a prescribed position, and one end of the developer passing control means is secured to the box member. Therefore, an image forming apparatus allowing high quality images by effectively and highly precisely positioning the developer passing control means can be manufactured with high productivity.

BEST MODE FOR CARRYING OUT THE INVENTION

An image forming apparatus according to one embodiment (referred to as "Embodiment A") of the present invention will be now described with reference to FIGS. 1 to 5.

Figure 1:
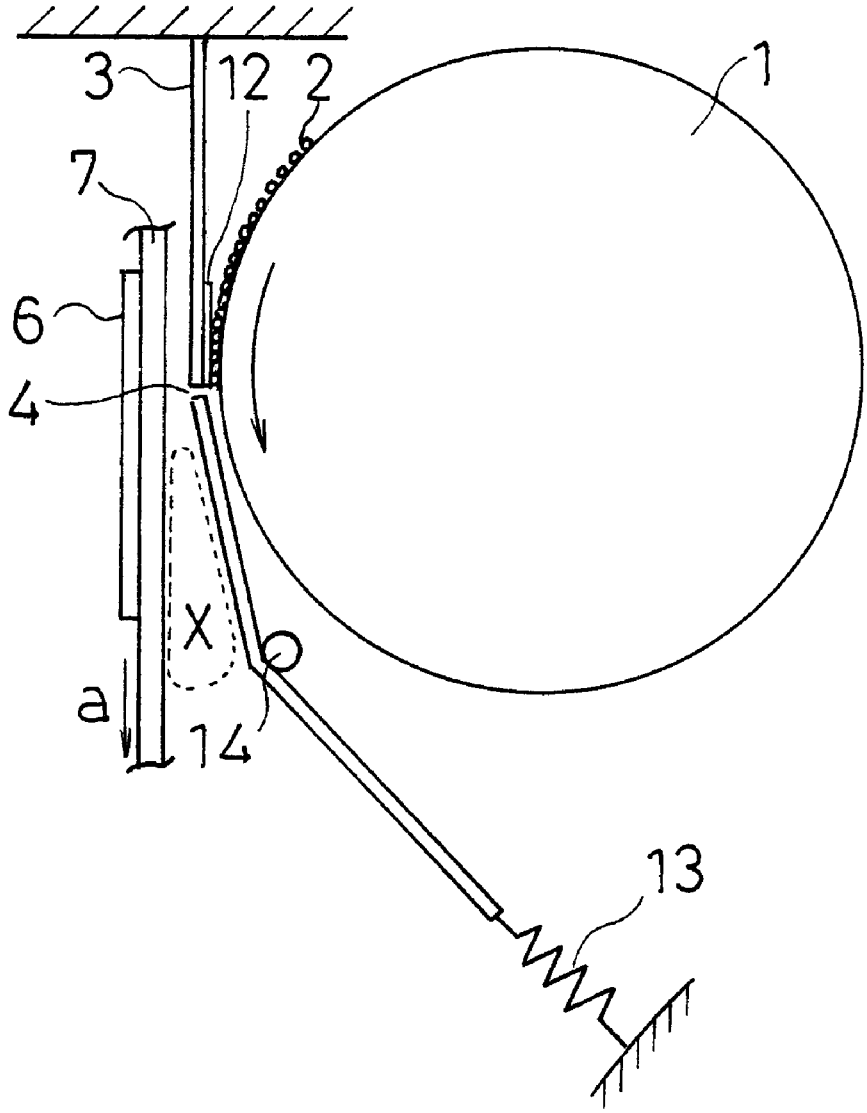
FIG. 1 is a sectional view showing the general structure of an image forming apparatus according to Embodiment A of the present invention.

In FIG. 1 showing the general structure of the image forming apparatus according to the embodiment, a toner carrier 1 carrying and transporting a charged toner 2, and the toner carrier 1 is made of a grounded rotatable sleeve and at a ground potential. The charged toner 2 is adhered in one to three thin layers.

A toner passing control means 3 is made of a flexible printed board having an effective width corresponding to the effective width of the toner carrier 1. The toner passing control means 3 is secured on the upstream side of the contact point with the toner carrier 1 in the moving direction of the toner carrier and secured on the downstream side through a spring 13. The contacting pressure between the toner carrier 1 and the toner passing control means 3 caused by the spring 13 at the time is appropriately in the range from 0.2 to 2 gf/mm$^2$. This is because in order to keep the constant distance between the toner carrier 1 and the toner passing control means 3 in the position of the toner passing hole, the toner carrier 1 and the toner passing control means 3 must always be in contact in the same state following the eccentricity of axial center of the rotation of the toner carrier 1, and the toner layer on the toner carrier 1 should not be deformed by excessively high contacting pressure. The contacting pressure slightly varies depending on the material of the toner carrier 1, the toner passing control means 3 and the like. Reference numeral 4 denotes a toner passing hole.

A back surface electrode 6 is provided opposing the toner carrier 1 with the toner passing control means 3 interposed therebetween. Reference numeral 7 denotes image receiving means such as recording paper and an image carrying belt transported in the direction of the arrow a in a fixed path between the back surface electrode 6 and the toner passing control means 3. A spacer 12 is provided at the surface of the toner passing control means 3 opposing the toner carrier 1 on the upstream side of the contact point with the toner carrier 1 with the contact point being inclusive in the moving direction of the toner carrier 1 and the spacer 12 serves to keep the constant distance between toner carrier 1 and the toner passing control means 3.

A stay 14 is linearly extending in the direction perpendicular to the moving direction of the toner carrier 1, and the stay 14 is provided on the downstream side of the contact point between the toner passing control means 3 and the toner carrier 1 in the moving direction of the toner carrier 1. The toner passing control means 3 is in contact with the stay 14 and slightly bends in the position of the stay 14. The toner passing control means 3 which will be described later in detail is typically made of a flexible resin film containing control electrodes 10 therein, and includes different kinds of materials with different modulus of elasticity. The film could be corrugated by tension as a result. Therefore, the toner passing control means 3 is contacted with the stay 14 in order to cancel the corrugation in the vicinity of the contact point with the stay 14 and the slight bending increases the contacting pressure and the resulting effect accordingly. As described above, the toner passing control means 3 is prevented from being corrugated, the spacer 12 provided at the toner passing control means 3 can be pressed evenly against the toner carrier 1 entirely in the direction of the toner passing hole row. As a result, no gap is produced between the spacer 12 and the toner carrier 1. Thus, the distance between the toner carrier 1 and the toner passing control means 3 can be constant and as thick as the spacer 12 in the direction of the toner passing hole row. The distance from the contact point between the toner passing control means 3 and the toner carrier 1 to the stay 14 is normally about 10 mm and desirably as short as possible, because the effect is less for greater distances. As denoted by the broken line in FIG. 1, the stay 14 is provided such that there is a gap part X formed between the toner passing control means 3 and the image receiving means 7 gradually expanding toward the downstream side in the moving direction of the image receiving means 7 from the toner passing hole 4. This is for the purpose of preventing the toner passed through the toner passing holes 4, flying and then sticking on the image receiving means 7 from returning to the toner passing control means 3 from the image receiving means 7.

Figure 2:
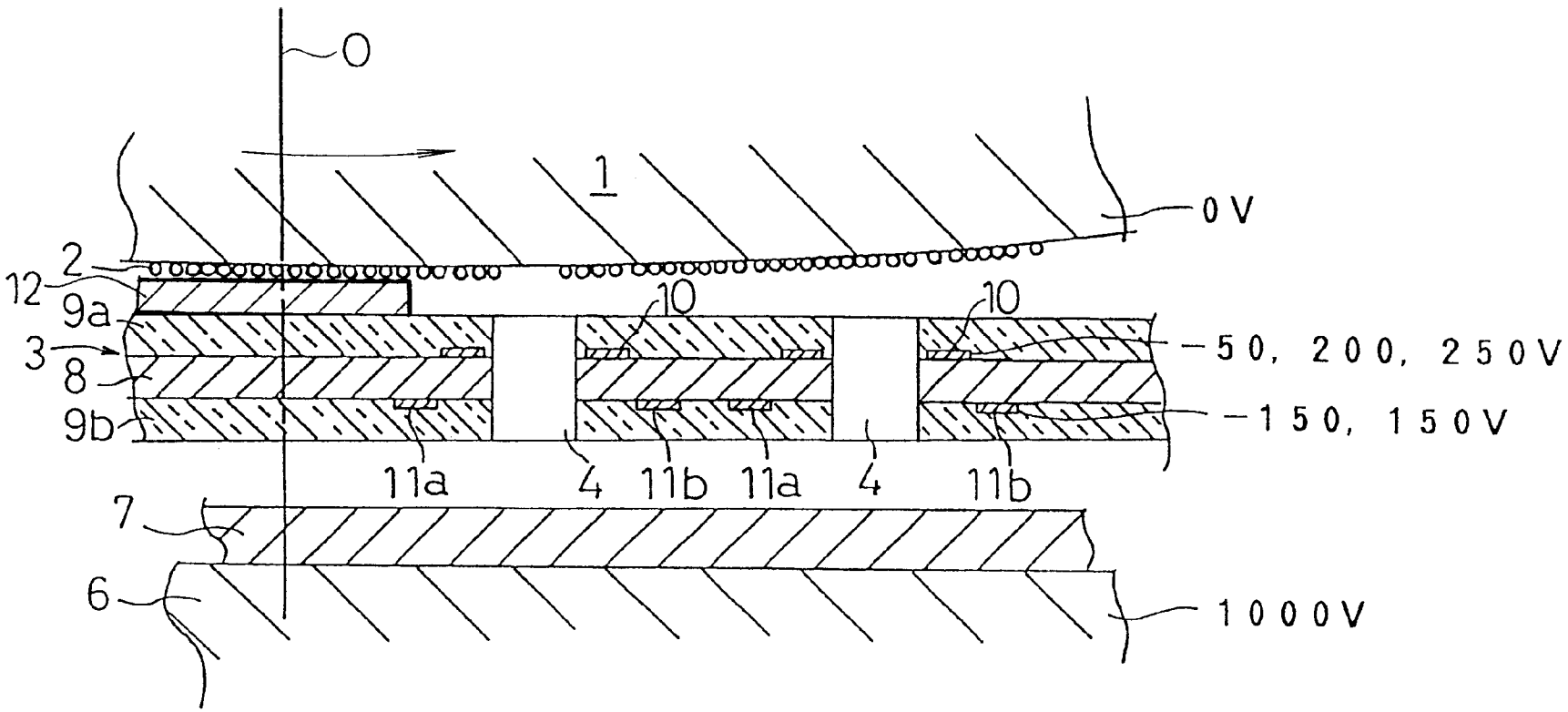
FIG. 2 is an enlarged vertical sectional view seen from the front showing a main part of the embodiment.

As shown in FIG. 2, the toner passing control means 3 includes a three-layer polyamide resin film having a main film about as thick as 50 $\mu$m and upper and lower cover films 9*a* and b about as thick as 10 to 30 $\mu$m attached to both sides of the a in film by an adhesive layer about as thick as 10 to 15 $\mu$m. the material and size of each film and the number of layers are by no means limited to these and may be designed as desired. In the example as shown, the toner passing holes 4 are provided in two rows in the moving direction of the toner carrier 1 at an appropriate distance apart on the downstream side of the contact point between the toner carrier 1 and the toner passing control means 3 in the moving direction of the toner carrier 1.

At the upper surface of the main film 8, a control electrode 10 is provided to surround each of the toner passing holes 4. At the lower surface of the main film 8, a pair of deflection electrodes 11*a* and 11*b* is provided to surround the toner passing hole 4 from both sides. These electrodes 10, 11*a*, and 11*b* are made of a patterned Cu film having a thickness of about 8 to 20 $\mu$m on the main film 8.

Figure 5A:
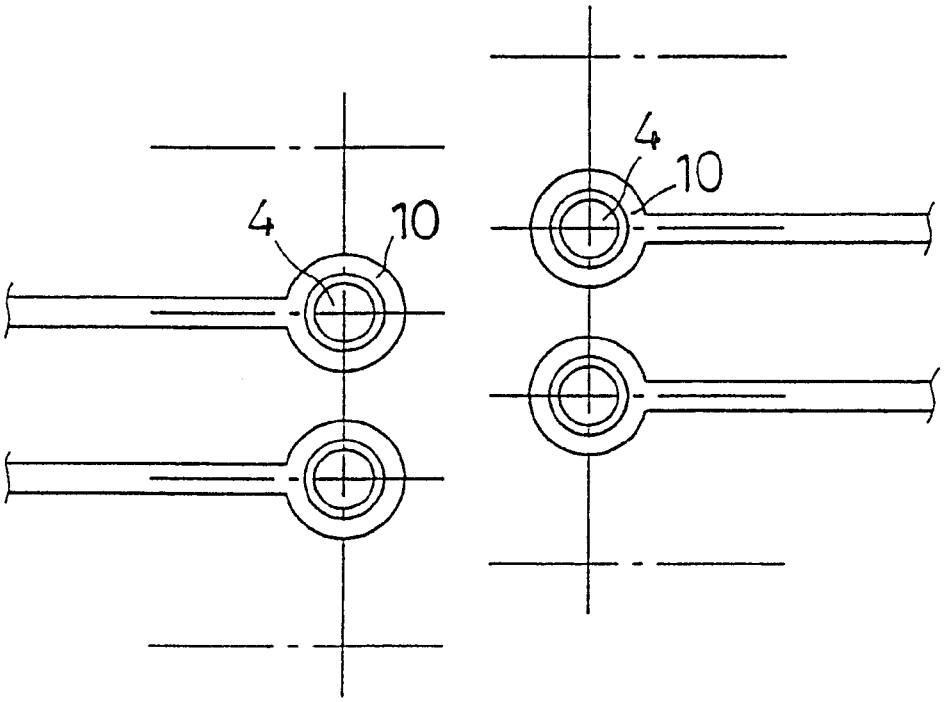
FIG. 5A is a plan view showing the arrangement of control electrodes according to the embodiment and FIG. 5B is a plan view showing the arrangement of the deflection electrodes according to the embodiment.

While the toner passing hole 4 is circular as shown in FIG. 5A, the hole may be oval or elliptical. In terms of size, the diameter is set about in the range from 70 to 120 $\mu$m. The surface roughness R of the inner circumferential wall surface of the toner passing hole 4 is not more than the average grain size of additives of the toner 2, 0.1 to 0.5 $\mu$m. The hole having the surface roughness R can be formed by perforation using an excimer laser or press working, or a YAG laser or a $CO_2$ laser may be used for perforation followed by a processing such as etching.

Figure 4:
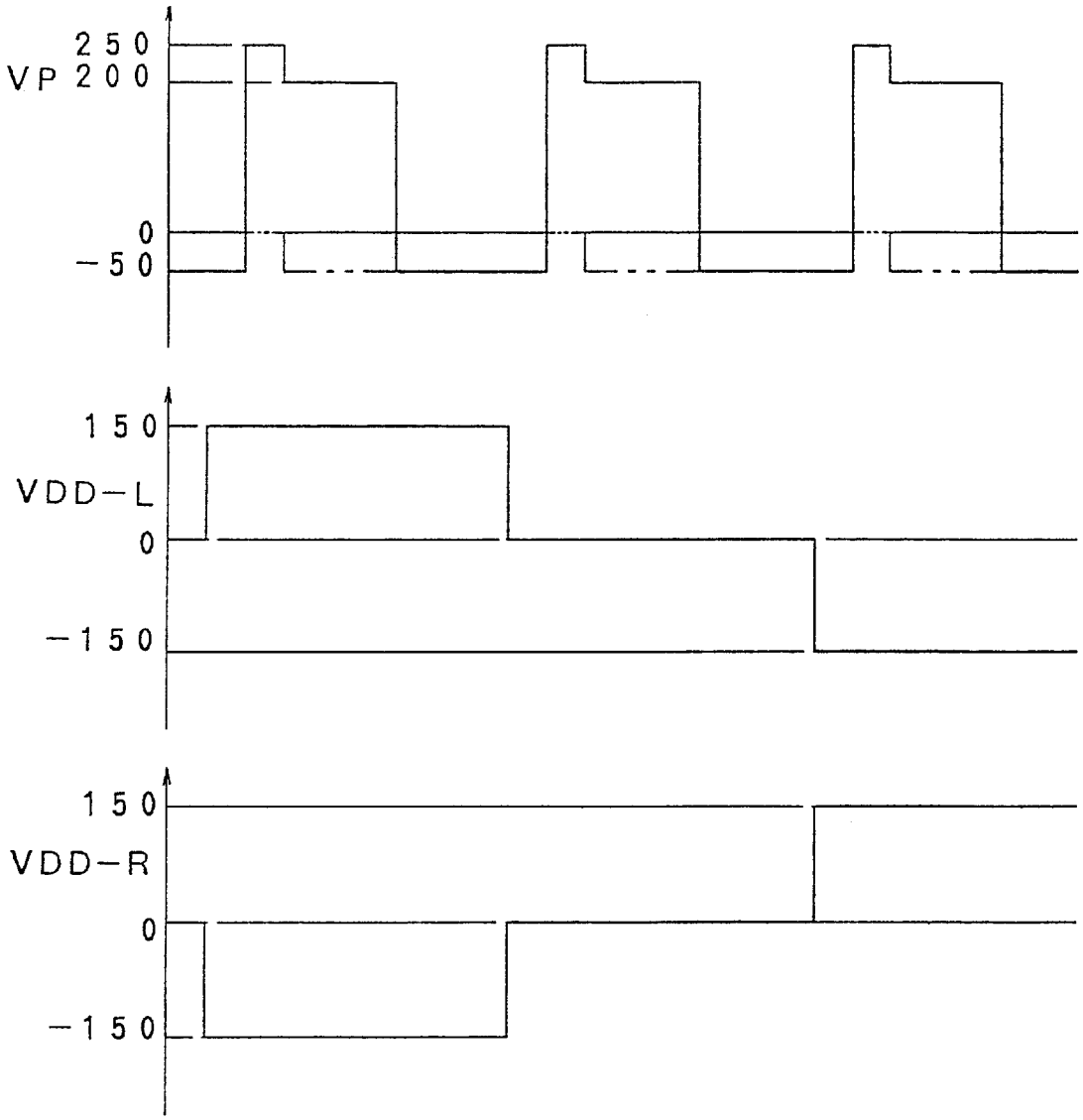
FIG. 4 is a time chart showing the timing of voltage applied to a control electrode and a deflection electrode according to the embodiment.
Figure 5B:
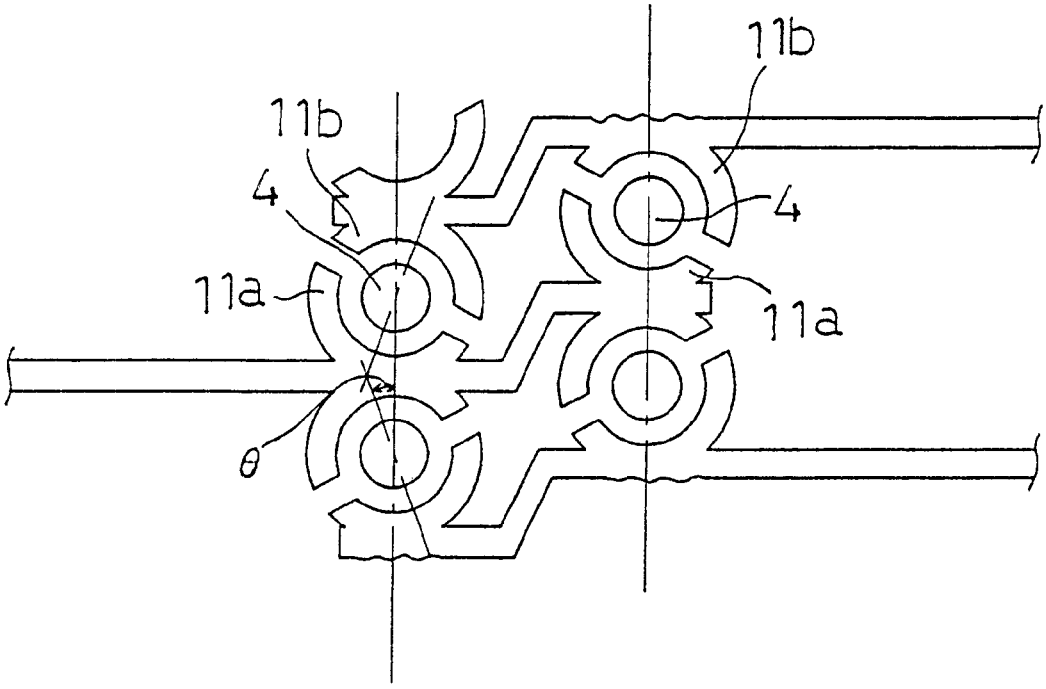
Figure 6:
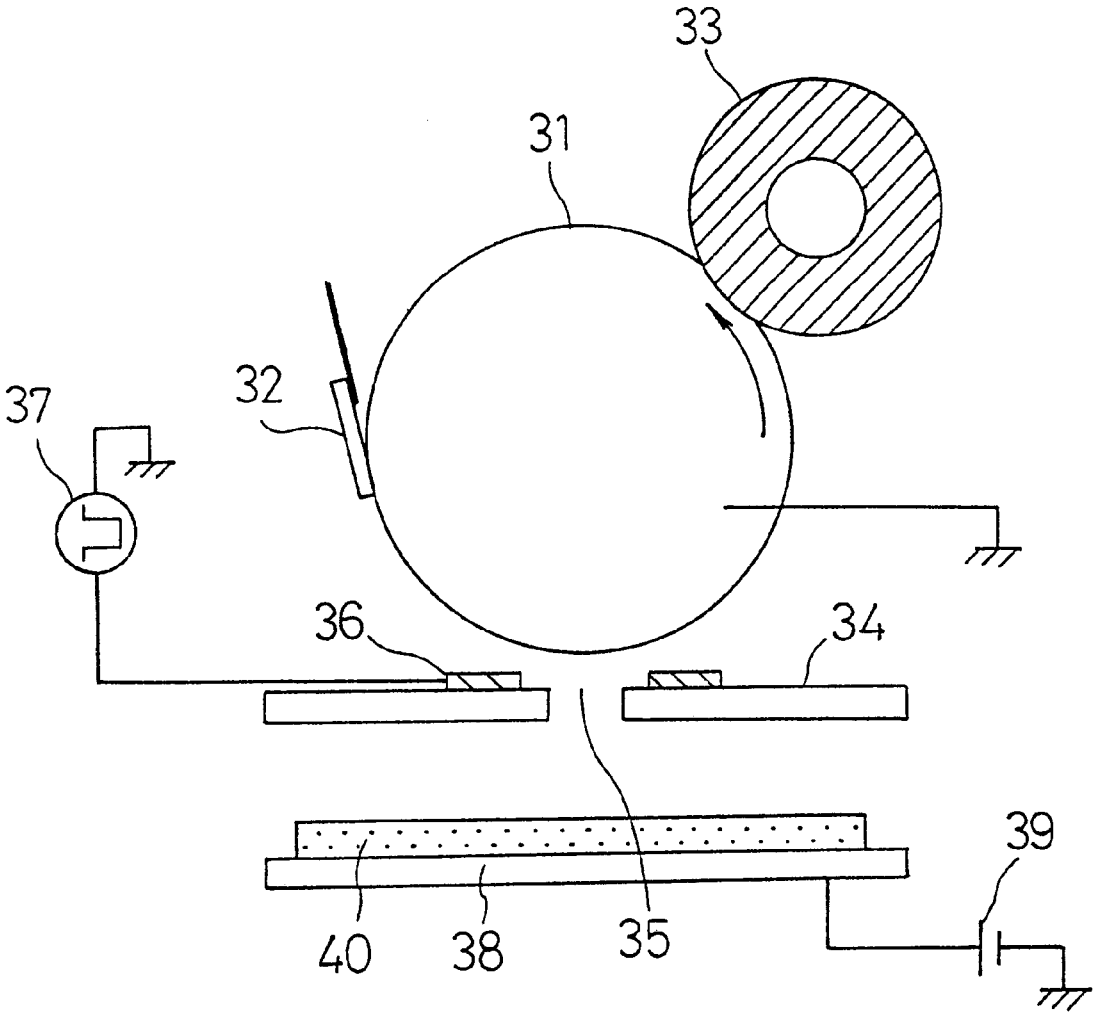
FIG. 6 is a view showing a main part of an image forming apparatus according to a conventional example.
Figure 7:
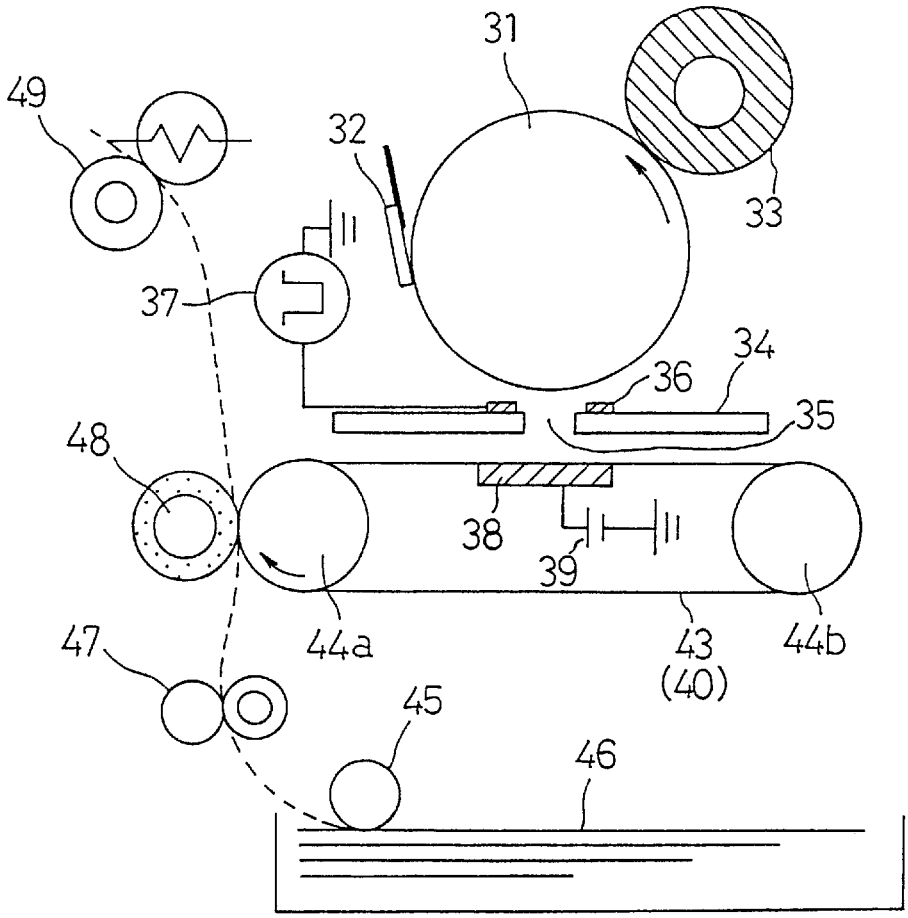
FIG. 7 is a view showing the general structure of the image forming apparatus according to the conventional example.
Figure 8:
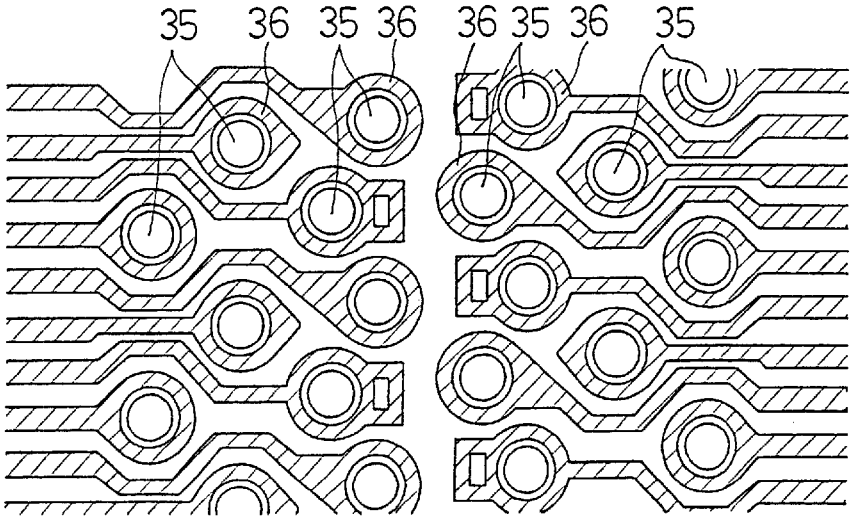
FIG. 8 is a plan view showing how electrodes are provided in the conventional example.

As shown in FIG. 5A, the control electrode 10 around the toner passing hole 4 preferably has a shape corresponding to the plan shape of the toner passing hole 4. In addition, as shown in FIG. 5B, the deflection electrodes 11*a* and 11*b* are shared between adjacent toner passing holes 4. In the above-described structure, a voltage $V_p$ applied to each control electrode 10 in the image forming operation is switched for example among −50V, 200V, and 250V, and voltages $V_{DD-L}$ and $V_{DD-R}$ applied to the deflection electrodes 11*a* and 11*b* are switched for example among 150V, 0V, and −150V in the timings as shown in FIG. 4. The voltage applied to the back surface electrode 6 is for example 1000V.

Figures 3A, 3B, 3C:
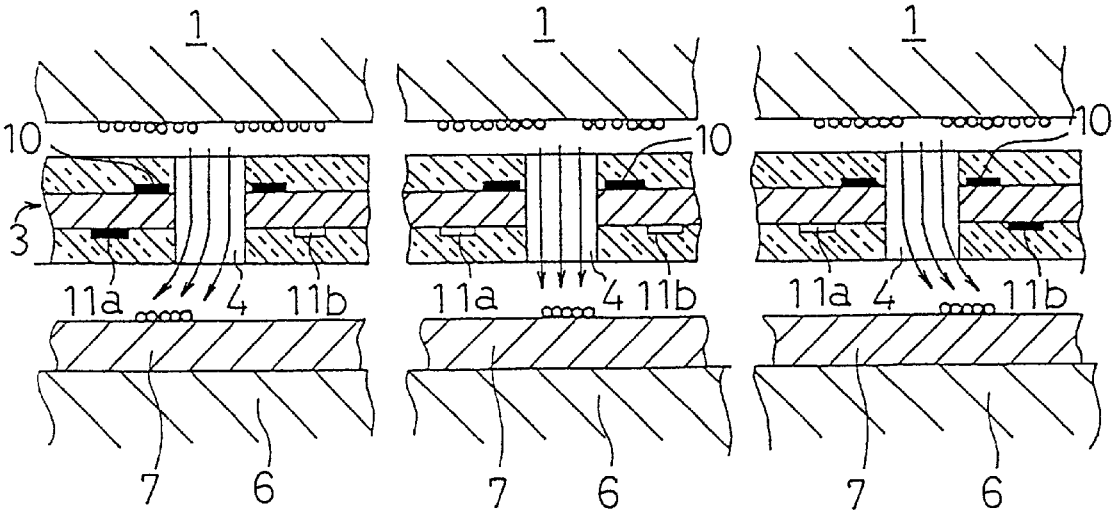
FIG. 3 is a vertical sectional view seen from the side showing three operation states at an arbitrary toner passing hole according to the embodiment.

In FIG. 4, at first the deflection electrodes 11*a* and 11*b* are both at 0V and the control electrode 10 is at −50V, so that the toner 2 adhered to the toner carrier 1 is unaffected by the electric field by the back surface electrode 7. Then, as the left deflection electrode 11*a* is provided with +150V and the right deflection electrode 11*b* is provided with −150V to deflect the negatively charged toner 2 to the left, the control electrode 10 is provided with a voltage of 250V to remove the toner 2 adhered to the toner carrier 1. A voltage of 200V is then applied to allow the toner 2 to pass through the toner passing hole 4, deflect and fly to the left as shown in FIG. 3A. Thus, the toner is applied in a position about 40 $\mu$m apart to the left from the position on the image receiving means 7 opposing the toner passing hole 4. Then, as the left and right defection electrodes 11*a* and 11*b* are both at 0V, a voltage is similarly applied to the control electrode 10, so that as shown in FIG. 3B, the toner 2 is applied on the image receiving means 7 in a position opposing the toner passing hole 4. Then, the left deflection electrode 11*a* is provided with −150V, and the right deflection electrode 11*b* is provided with +150V to deflect the negatively charged toner 2 to the right. In the state, a voltage is similarly applied to the control electrode 10, so that as shown in FIG. 3C, the toner is applied on the image receiving means 7 in a position again about 40 $\mu$m displaced to the right from the position opposing the toner passing hole 4. Thus, by sequentially switching the voltage applied to the control electrode 10, and the deflection electrodes 11*a* and 11*b*, the toner can be applied to three points, i.e., points in the left, right, and center through a single toner passing hole 4.

Note that in order to block the toner 2 through the toner passing hole 4, the voltage applied to the control electrode 10 is raised from −50V to 0V as denoted by the virtual line, so that the part of the toner 2 charged to the opposite polarity (the positive polarity) and deposited on the surface of the toner passing control means 3 moves to return to the side of the negatively charged toner 2 adhered to the toner carrier 1. Then, the negatively charged toner 2 is deposited around the toner passing hole 4 with the toner 2 of the opposite polarity deposited at the upper part of the control electrode 10 acting as a core. As a result, the toner passing hole 4 may be prevented from clogging.

An image forming apparatus according to another embodiment (referred to as "Embodiment B-1") of the present invention will be now described with reference to FIGS. 9 and 10.

Figure 9:
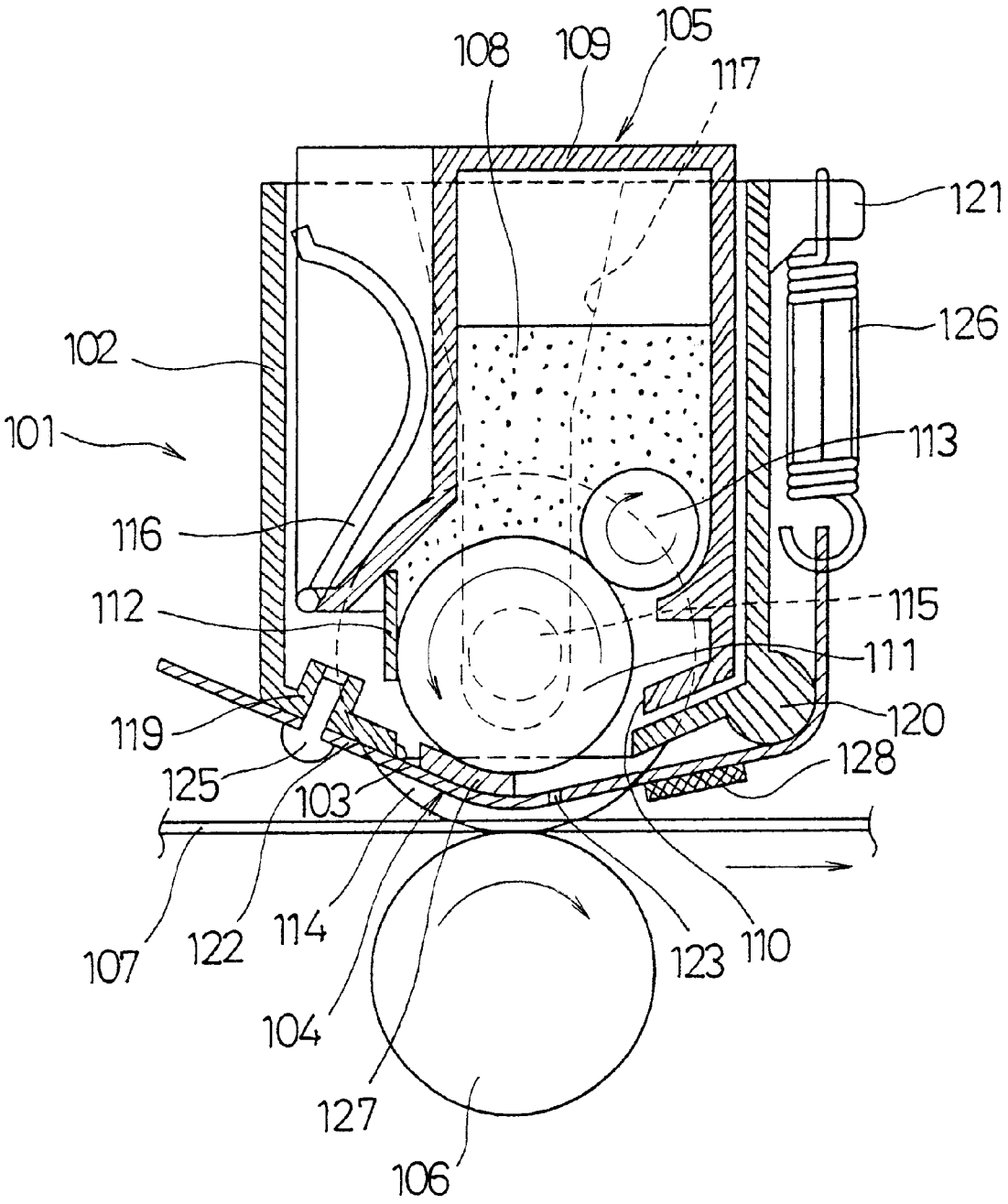
FIG. 9 is a vertical sectional view showing the general structure of an image forming apparatus according to Embodiment B-1 of the present invention.
Figure 10A:
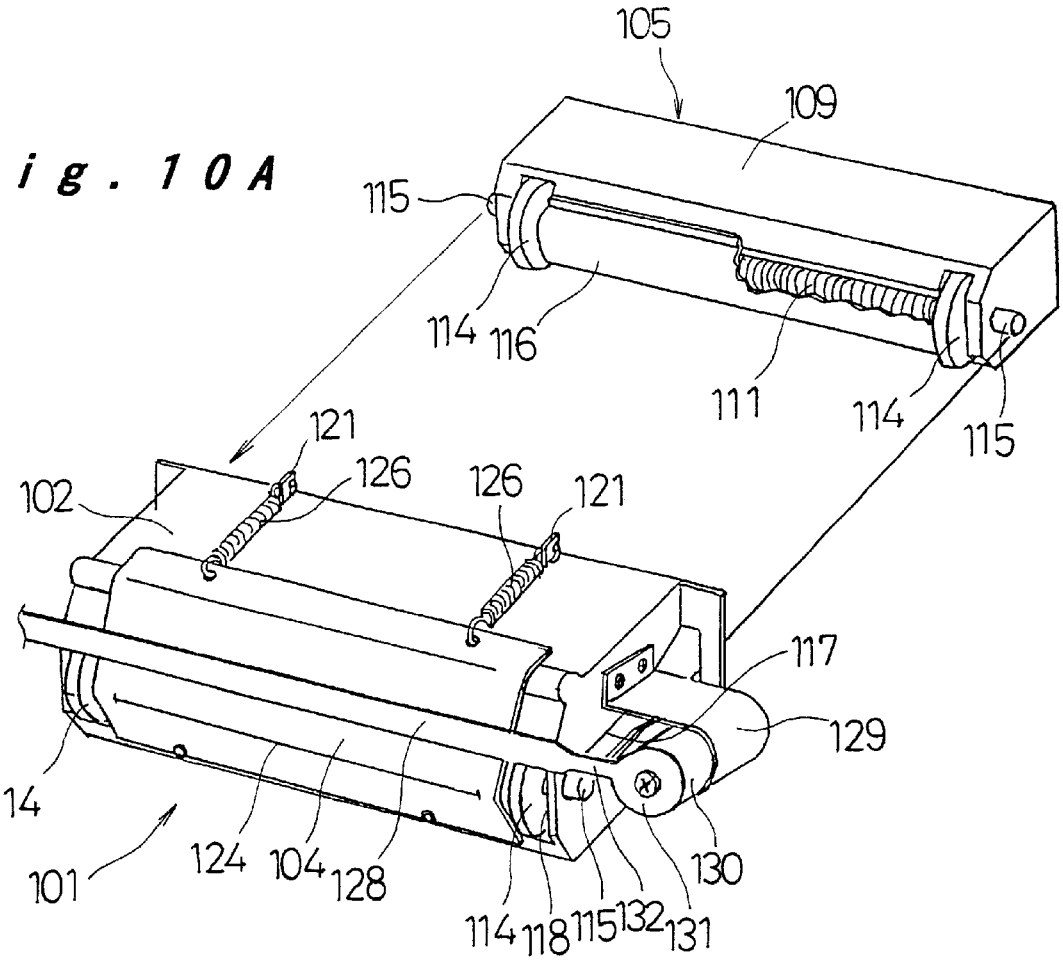
FIG. 10A is a perspective view showing the structure of the print head and the step of mounting a toner cartridge according to the embodiment.

In FIGS. 9 and 10A showing the general structure of the image forming apparatus, A print head 101 having its upper surface opened, and includes at the lower end a box member 102 having a developer supply opening 103, developer passing control means 104 provided at the lower outer surface of the box member 102 to cover the developer supply opening 103, and a developer supply unit 105 detachably provided in the box member 102 (hereinafter referred to as "toner cartridge"). A back surface electrode 106 is provided an appropriate distance apart under the print head 101, and an image receiving member 107 such as recording paper is passed between the back surface electrode 106 and the print head 101.

The toner cartridge 105 includes a developer storing container storing a toner 108 as a developer, a developing roller 111 serving as both developer carrying and transporting means provided facing against a developer feeding opening 110 opened in a large range at the lower portion of the developer storing container 109, a restriction blade 112 restricting the toner layer carried by the developing roller 111 and transported to the outside of the developer feeding opening 110, and a supply roller 113 stirring the toner 108 in the developer storing container 109, thereby causing friction charging, and supplying the developing roller 111 with the toner 108.

At the outside of the both ends of the developing roller 111 in the axial direction, there is a restriction collar 114 in abutment against the back surface electrode 106 for restricting the distance between the developing roller 111 and the back surface electrode 106 to be constant. The restriction collar 114 may be used to set the distance between the back surface electrode 106 and the developing roller 111 in the range from 150 to 1000 $\mu$m, 350 $\mu$m according to the embodiment.

A guide shaft 115 coaxial with the developing roller 111 is provided to project from both ends of the developer storing container 109. Reference numeral 116 denotes a protection cover to close the developer feeding opening 110 for protecting the developing roller 111 during the transportation of the toner cartridge 105.

The toner 108 is held between the developing roller 111 and the restriction blade 112, stirred slightly in the position, and charged with charges received from the developing roller 111. According to the embodiment, the toner 108 used is a non-magnetic substance having negative charges of −10 μC/g and an average grain size of 8 μm.

The developing roller 111 is made of a metal such as aluminum and iron or an alloy. According to the embodiment, an aluminum tube having an outer diameter of 20 mm and a thickness of 1 mm is used. The restriction blade 112 is made of an elastic material such as urethane. Appropriately, the hardness is in the range from 40° to 80° (measured by the JIS K6301A hardness measurement scale), the free end length (the length of the portion extending from the attached part) is in the range from 5 to 15 mm, the line pressure on the developing roller 111 is in the range from 5 to 40 g/cm, and the toner 108 is formed into one to three layers on the developing roller 111. The restriction blade 112 is in an electrically floating state according to the embodiment.

The supply roller 113 is produced by providing synthetic rubber such as polyurethane foam having a thickness about in the range from 2 to 6 mm on a metal shaft such as iron (having a diameter of 8 mm according to the embodiment). Preferably, the hardness is 30° (measured in a roller shape by the JIS K6301A hardness measurement scale), and the roller is used to aid in charging the toner 108 and also controls the supply of the toner. The amount of biting to the developing roller 111 is preferably from 0.1 to 2 mm.

These developing roller 111, restriction blade 112, and supply roller 113 may be electrically grounded or provided with a DC or AC voltage, or the restriction blade 112 may be in an electrically floating state.

The back surface electrode 106 serves as a counter electrode and forms an electric field between the developing roller 111 and itself, and the electrode is a metal plate or produced by dispersing a conductive filler within resin. A DC voltage about in the range from 500 to 2000V may be applied to the back surface electrode 106, and a voltage of 1000V is applied according to the embodiment.

The box member 102 has guide grooves 117 formed at both end walls opposing the both ends of the developing roller 111 in the axial direction for positioning the toner cartridge 105 as the guide shaft 115 of the toner cartridge 105 is inserted therein. Openings 118 through which the restriction collars 114 penetrate are formed outside both ends of the developer supply opening 103. A securing portion 119 for securing one end of the developer passing control means 104 is formed at one side of the developer supply opening 103 of the box member 102. A stay portion 120 having a circular cross section for bending the other end side of the developer passing control means 104 upwardly is formed to project at the other side of the developer supply opening 103. A pair of spring hooks 121 is provided an appropriate distance apart at the upper end.

In the manufacture of the developer passing control means small pitch in an insulating base member 122in the width-wise direction of the image receiving member 107 to form a single or multiple small hole rows 124, and a ring-shape image signal electrode is formed to surround each small hole 123. Meanwhile, a control signal electrode is formed at the back surface of the insulating base member 122 so as not to overlap the image signal electrode. The insulating base member 122 is preferably of a material such as polyamide and polyethylene terephthalate and appropriately as thick as 10 to 100 μm.

According to the embodiment, polyamide as thick as 50 μm is used for the insulating base member 122. The small holes 123 have a diameter of 145 μm, the image signal electrode is in a ring shape having an inner diameter of 150 μm and an outer diameter of 250 μm, and the control signal electrode has an inner diameter of 250 μm. A thin resin layer having a thickness of 1 to 2 μm is provided on the surface of each electrode. The image signal electrode is made of a foil of metal such as copper having a thickness in the range from 5 to 30 μm, and each independently connected through a lead to an image signal output portion serving as image signal voltage switching means. A voltage of not more than 400V is normally applied to the image signal electrode, and in the present embodiment a voltage of 300V is applied for forming dots, while a voltage of −100V is applied for avoiding forming dots.

One distal end of the developer passing control means 104 is secured to the securing portion 119 of the box member 102 by a securing screw 125. The other distal end bent by the stay portion 120 is engaged with the spring hooks 121 through a pair of extension springs 126. A spacer 127 is mounted at the inner surface of the developer passing control means 104 on the upstream side of the small hole row 124 in the moving direction of the developing roller 111. The spacer 127 may set the distance between the toner layer on the developing roller 111 and the developer passing control means 104 highly precisely in the range from 0 to 200 μm, to 50 μm according to the present embodiment.

A diaphragm 128 of a metal plate is rigidly attached along the small hole row 124 on the outer surface of the developer passing control means 104 between the small hole row 124 and the stay portion 120. More specifically, a stainless steel plate having a width of 5 mm and a thickness of 0.2 mm, for example, may be used. As shown in FIG. 10A, an attachment bracket 129 attached to one end surface of the box member 102 is used to rigidly support ultrasonic vibration generating means 130 for generating ultrasonic vibration. The tip end of a coupling plate portion 131 extending to one end side of the diaphragm 128 is screwed to the output end of the ultrasonic vibration generating means 130. The vibration by the ultrasonic vibration generating means 130 may be in the form of a sine wave at a vibrating frequency of not more than 1 MHz, preferably for example about 20 KHz. This is because for higher vibrating frequencies, the toner 108 and the developer passing control means 104 vibrate similarly, and sticking and depositing of the toner 108 in the passage cannot be prevented. The coupling plate portion 131 has a width-reduced portion 132 so that ultrasonic vibration can be transmitted while permitting relative displacement between the ultrasonic vibration generating means 130 and the diaphragm 128.

In the image forming apparatus having the above-described structure, when the toner cartridge 105 is mounted, as shown in FIG. 9, the protection cover 116 is in an open state, the guide shaft 115 is guided and engaged with the guide groove 117 to allow the toner cartridge 105 to be inserted into the box member 102 and thus set urged under prescribed pressing force or higher. Then, the engagement of the guide shaft 115 and the guide groove 117 positions the developing roller 111 and the small hole row 124 of the developer passing control means 104 to be parallel in prescribed positional relation in the horizontal direction as shown in FIG. 9, while the restriction collar 114 abuts against the back surface electrode 106, so that the gap between the developing roller 111 and the back surface electrode 106 is set highly precisely to a prescribed value. At the same time, the developing roller 111 abuts against the developer passing control means 104 through the spacer 127 and the developer passing control means 104 is pressed against the urging force of the extension spring 126 and displaced. The gap between the developing roller 111 and the developer passing control means 104 is set highly precisely to a prescribed distance.

At the time of forming images, application of a voltage at a prescribed value or higher in response to an externally applied signal to the image signal electrode of the developer passing control means 104 causes an electric field formed between the developing roller 111 and the back surface electrode 106 to be exposed, or an accelerated electric field is formed between the developing roller 111 and the image signal electrode. These electric fields directly or indirectly draw the toner 108 toward the back surface electrode 106, and the toner 108 arrives on the image receiving member 107. Meanwhile, application of a electric charge at a prescribed voltage or lower to the image signal electrode prevents an electric field from being formed between the developing roller 111 and the back surface electrode 106, and the toner 108 does not arrive on the image receiving member 107. Thus, the arriving toner 108 forms images on the image receiving member 107.

During the image forming operation or at appropriate time intervals, the ultrasonic vibration generating means 130 is operated and the ultrasonic vibration therefrom is transmitted to the developer passing control means 104 through the coupling plate portion 131 and the diaphragm 128. As a result, the toner 108 sticking around or inside small holes 123 in the developer passing control means 104 is effectively removed and the developer passing control means 104 is always maintained in a cleaned state.

Here, the diaphragm 128 rigidly attached to the developer passing control means 104 and the ultrasonic vibration generating means 130 are coupled through the coupling plate portion 131 having the width-reduced portion 132 so that relative displacement with each other is allowed. Therefore, at the time of mounting the toner cartridge 105, the displacement of the developer passing control means 104 is allowed while ultrasonic vibration is surely transmitted, so that stable cleaning performance as well as stable image formation can be achieved. Meanwhile, there is little possibility of distortion generated in the developer passing control means 104 and therefore high quality images can be formed.

Figure 10B:
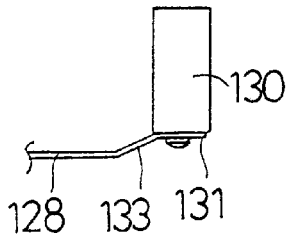
FIG. 10B is a partial plan view showing another structure of the coupling plate portion of a vibrating member according to the embodiment and FIG. 10C is a partial plan view showing yet another structure of the coupling plate portion of the vibrating member according to the embodiment.
Figure 10C:
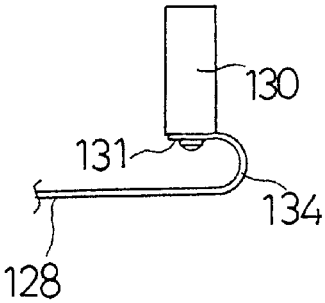

In the foregoing description, in order to allow the displacement of the developer passing control means 104 as the ultrasonic vibration is surely transmitted, the width-reduced portion 132 is provided at the coupling plate portion 131. Meanwhile, the coupling plate portion 131 may be provided with a bent portion 133 as shown in FIG. 10B or a U-shaped portion 134 as shown in FIG. 10C and the bent portion 133 or the U-shaped folded back portion 134 may be reduced in width. These portions may be designed as desired depending upon the actual construction or size of the print head 101 so that the optimum effect results.

An image forming apparatus according to another embodiment (referred to as "Embodiment B-2") of the present invention will be now described with reference to FIGS. 11 and 12. In the following description of the embodiment, the same elements as those in the aforementioned embodiments will be denoted by the same reference numerals and will not be detailed and only the different features will be described.

According to the embodiment, instead of the stay portion 120 integral with the box member 102, a stay rod 135 rotatable within a prescribed rotation range around its own axis is provided to the box member 102. Developer passing control means 104 is secured to the stay rod 135 and ultrasonic vibration generating means 130 is coupled to one end of the stay rod 135, so that the stay rod 135 is also used as a vibrating member. Reference numeral 136 denotes a backing plate placed on the developer passing control means 104 and secured by a securing screw 137. The ultrasonic vibration generating means 130 is provided pivotally around the axis of the stay rod 135 at a supporting body (not shown) mounted at the box member 102.

According to the embodiment, ultrasonic vibration generated by the ultrasonic vibration generating means 130 can be transmitted to the developer passing control means 104 effectively with the stay rod 135 serving as a vibrating member, so that a great cleaning effect results. In addition, the rotation of the stay rod 135 allows the displacement of the developer passing control means 104 to be naturally and smoothly absorbed.

Figure 11:
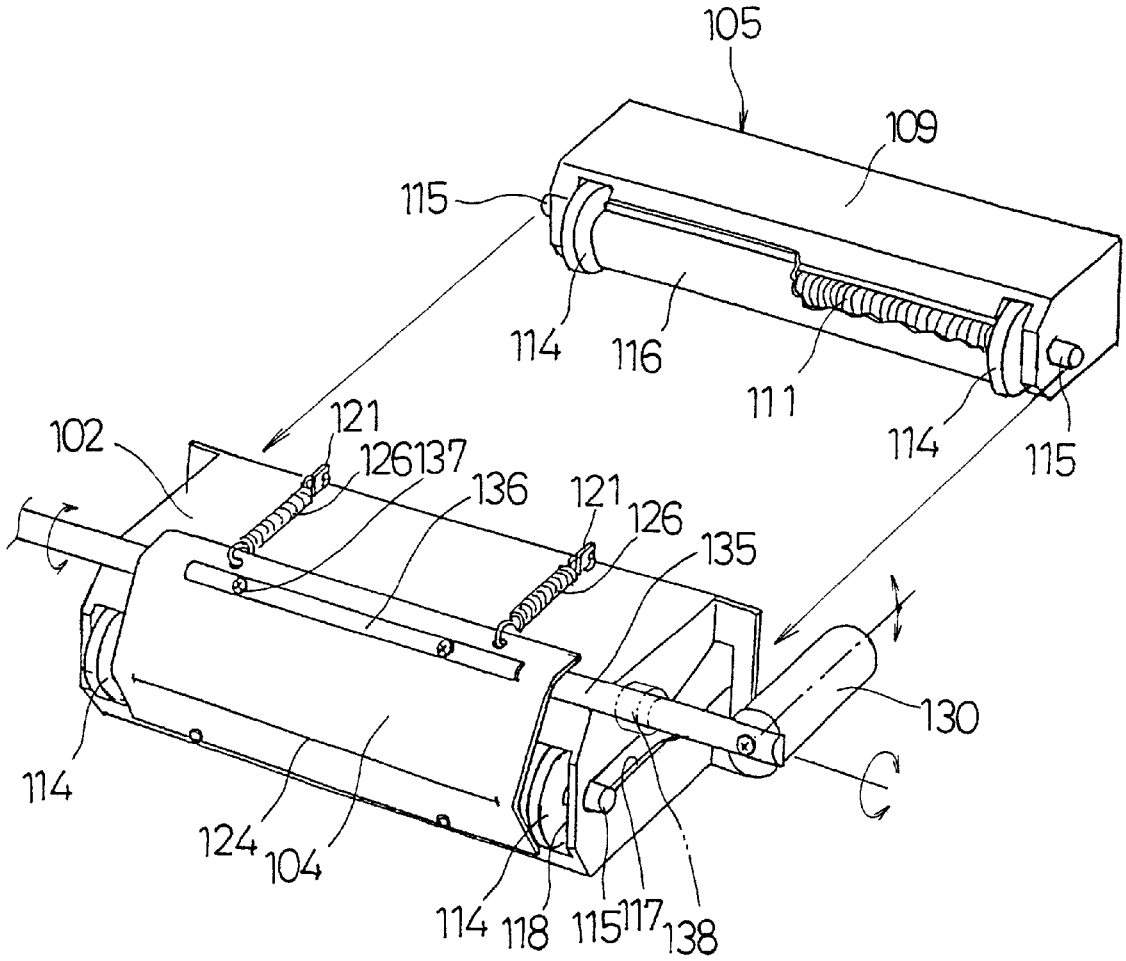
FIG. 11 is a perspective view showing the structure of a print head in an image forming apparatus according to Embodiment B-2 of the present invention and the step of mounting a toner cartridge.
Figure 12:
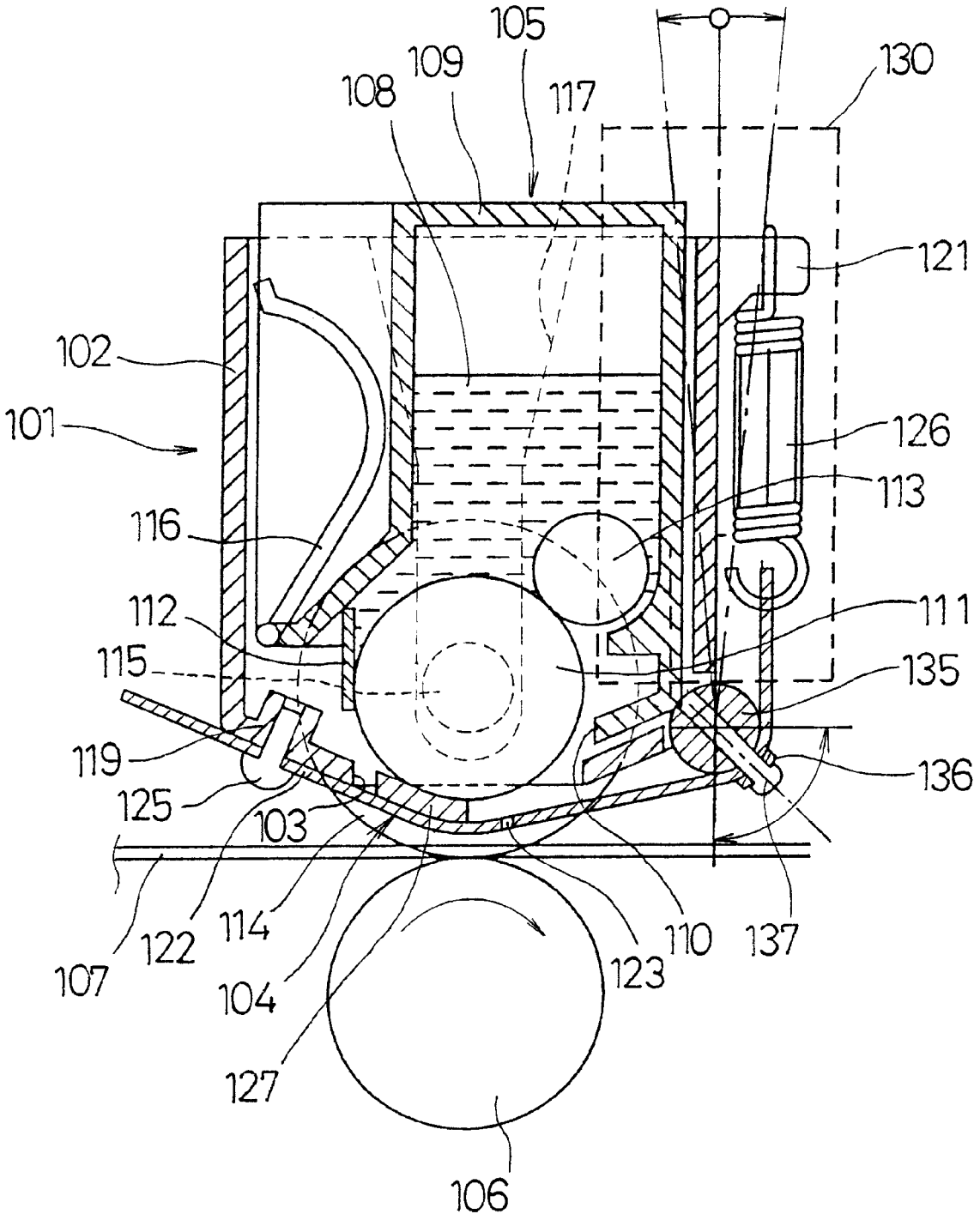
FIG. 12 is a vertical sectional view showing the general structure of the embodiment.

As denoted by the imaginary line in FIG. 11, there may be rotational coupling means 138 coupling relatively rotatably within a prescribed range somewhere at the stay rod 135 in a position between the developer passing control means 104 and the ultrasonic vibration generating means 130, so that the ultrasonic vibration generating means 130 can be rigidly supported at the box member 102, in other words, the ultrasonic vibration generating means 130 may have a simple supporting structure.

Figure 13:
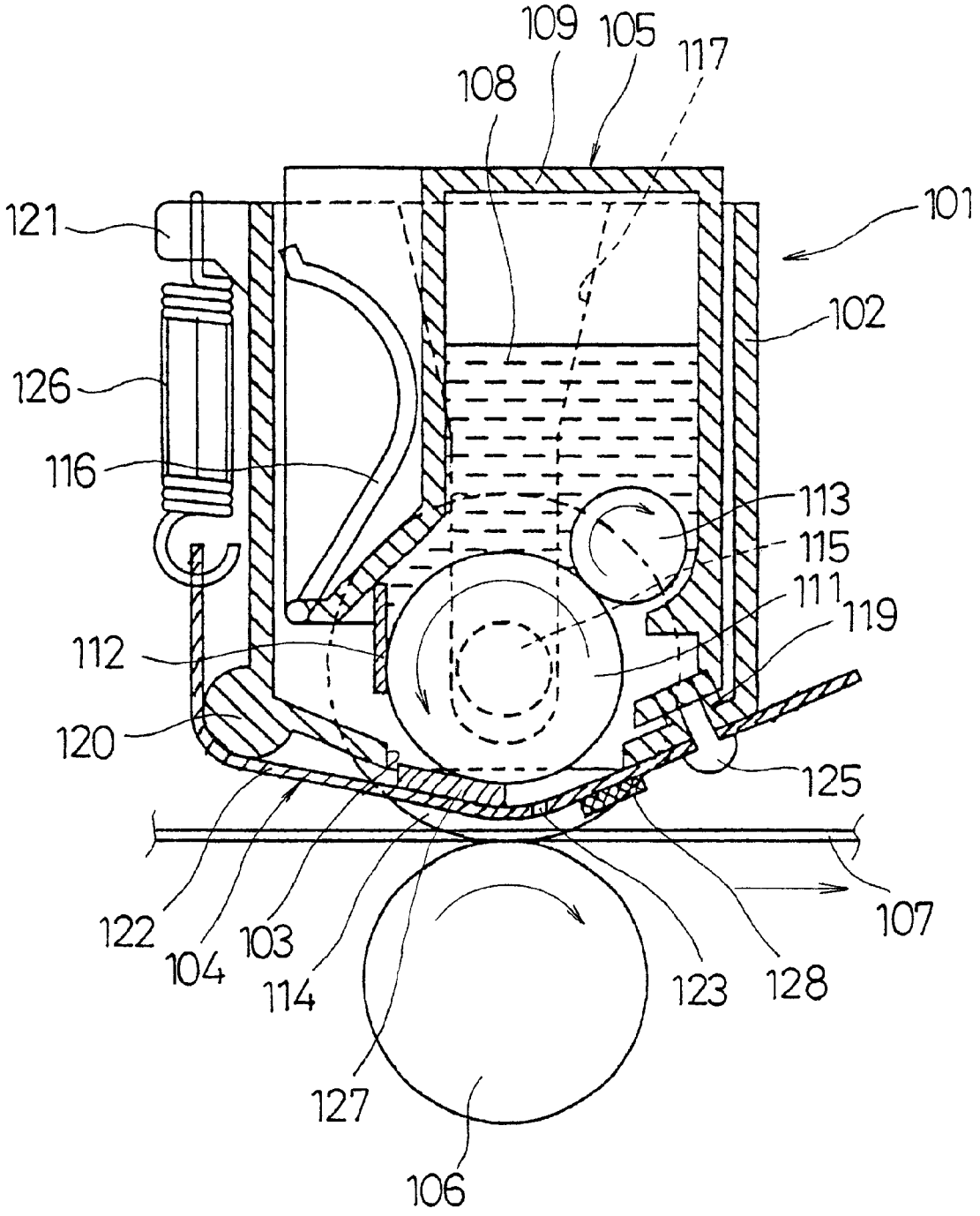
FIG. 13 is a vertical sectional view showing the general structure of an image forming apparatus according to Embodiment B-3 of the present invention.

An image forming apparatus according to yet another embodiment (referred to as "Embodiment B-3") of the present invention will be now described in conjunction with FIG. 13.

According to the embodiment, the securing portion 119 of the box member 102 is provided on the downstream side of the small hole row 124 in the moving direction of the developing roller 111, and one end of the developer passing control means 104 is secured to the securing portion by a securing screw 125. The other end of the developer passing control means 104 is bent by the stay portion 120 and engaged with spring hooks 121 through a pair of extension springs 126. The extension springs 126 are provided on the upstream side of the small hole row 124 in the rotation direction of the developing roller 111.

A diaphragm 128 of a metal plate is rigidly attached along the small hole row 124 at the outer surface of the developer passing control means 104 in a position between the small hole row 124 and the securing portion 119. Similarly to the Embodiment B-1, a spacer 127 is mounted at the inner surface of the developing roller 111 on the upstream side of the small hole row 124 in the developer passing control means 104 in the moving direction of the developing roller 111.

Here, the diaphragm 128 has such a shape that the diaphragm 128 rigidly attached to the developer passing control means 104 and the ultrasonic vibration generating means 130 can be displaced relatively to each other. According to the embodiment, with reference to the position where the developing roller 111 and the developer passing control means 104 are in direct or indirect contact, the diaphragm 128 is provided in a position on the opposite side of the extension spring 126 (in a position between the small hole row 124 in the developer passing control means 104 and the securing portion 119). Therefore, the displacement of the diaphragm 128 at the time of mounting the toner cartridge 105 is smaller than the case of the Embodiment B-1. As a result, simply by providing a width-reduced portion 132 at the coupling plate portion 131 between the diaphragm 128 and the ultrasonic vibration generating means 130, or without forming any such width-reduced portion 132, the structure allows necessary relative displacement of the diaphragm 128 and the ultrasonic vibration generating means 130 in quite a simple structure.

Figure 14:
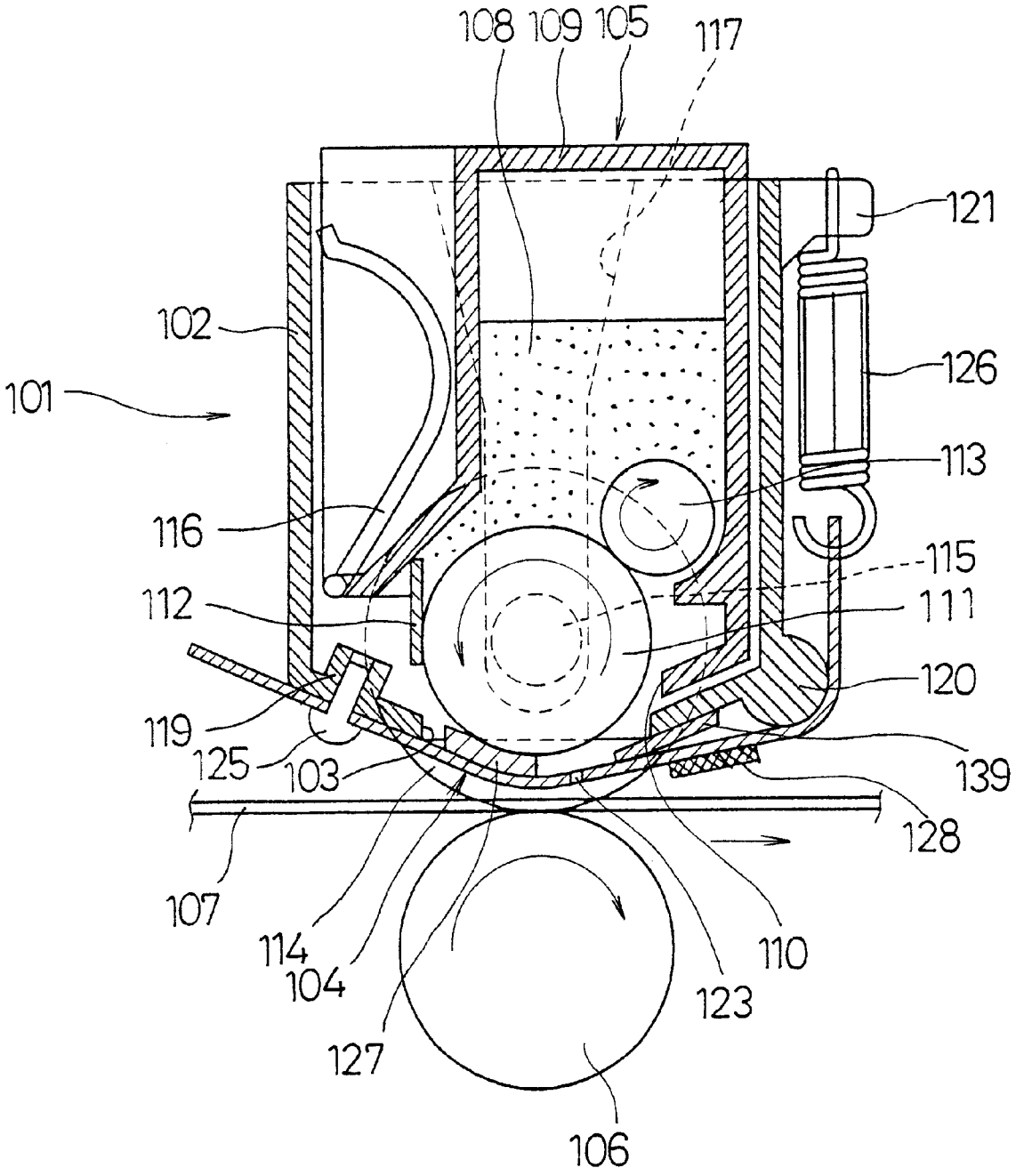
FIG. 14 is a vertical sectional view showing the general structure of an image forming apparatus according to Embodiment B-4 of the present invention.
Figure 15:
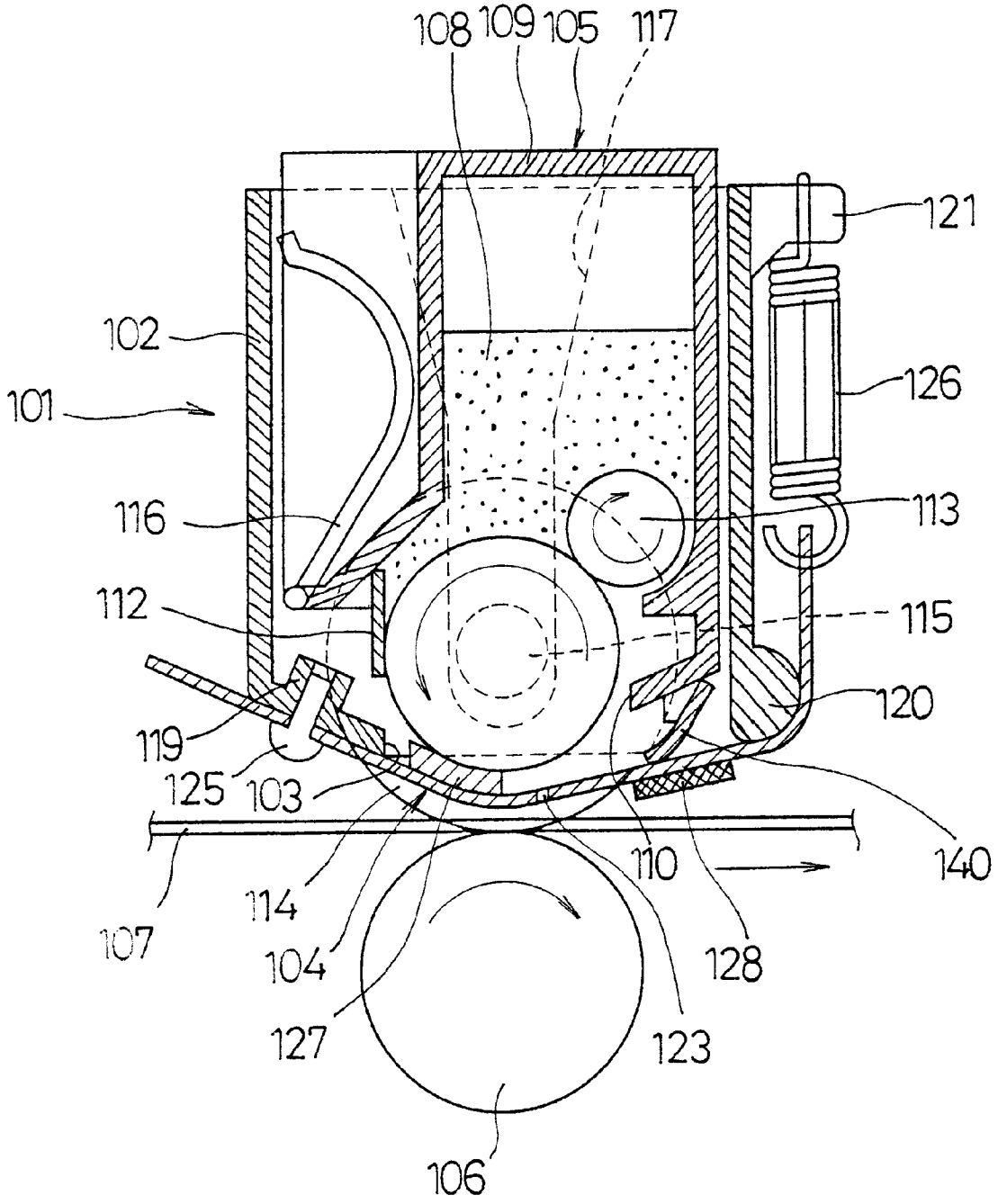
FIG. 15 is a vertical sectional view showing a variation of the embodiment.

An image forming apparatus according to another embodiment (referred to as "Embodiment B-4") of the present invention will be now described in conjunction with FIGS. 14 and 15.

In FIG. 14, at the outer surface of the side edge on the downstream side of the developer supply opening 103 in the box member 102 in the rotation direction of the developing roller 111, there is a seal blade 139 having a tip end in contact under pressure with the inner surface of the developer passing control means 104.

In FIG. 15, at the outer surface of the side edge of the developer feeding opening 110 on the downstream side in the rotation direction of the developing roller 111 in the developer storing container 109 in the toner cartridge 105, there is mounted a seal blade 140 having a tip end in contact under pressure with the inner surface of the developer passing control means 104 through the developer supply opening 103 in the box member 102.

These seal blades 139 and 140 are made of PET as thick as 0.1 mm or less or urethane rubber as thick as 0.3 mm or less.

According to the embodiment, similarly to the above Embodiment B-1, the developer passing control means 104 can be provided with ultrasonic vibration through the diaphragm 128 to clean the developer passing control means 104. The seal blades 139 and 140 surely prevent the leakage of the toner. 108 to the outside along the inner surface of the developer passing control means 104 caused by the vibration.

An image forming apparatus according to another embodiment (referred to as "Embodiment C-1") of the present invention will be now described in conjunction with FIGS. 16 to 19.

Figure 16:
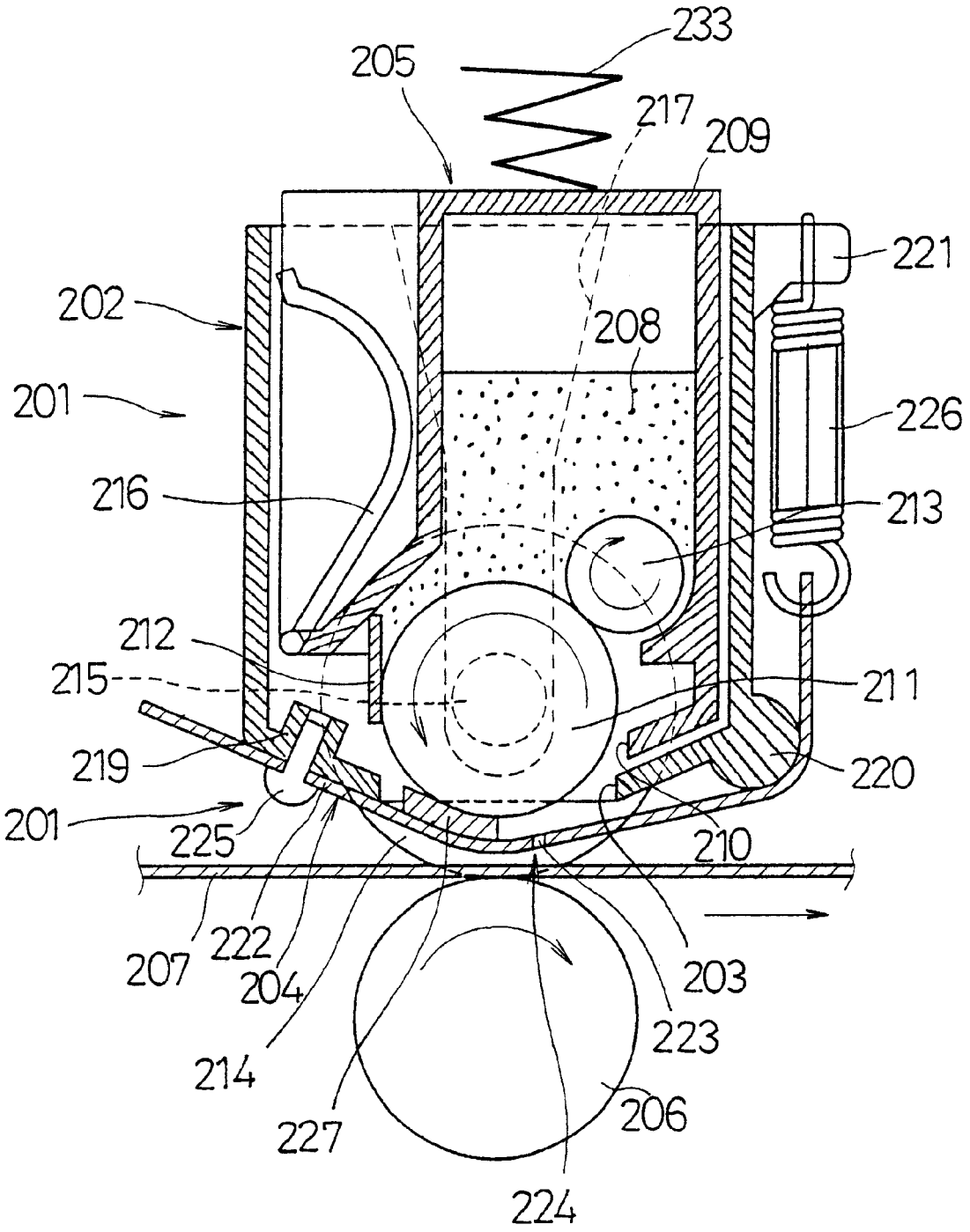
FIG. 16 is a vertical sectional view showing the general structure of an image forming apparatus according to Embodiment C-1 of the present invention.
Figure 17:
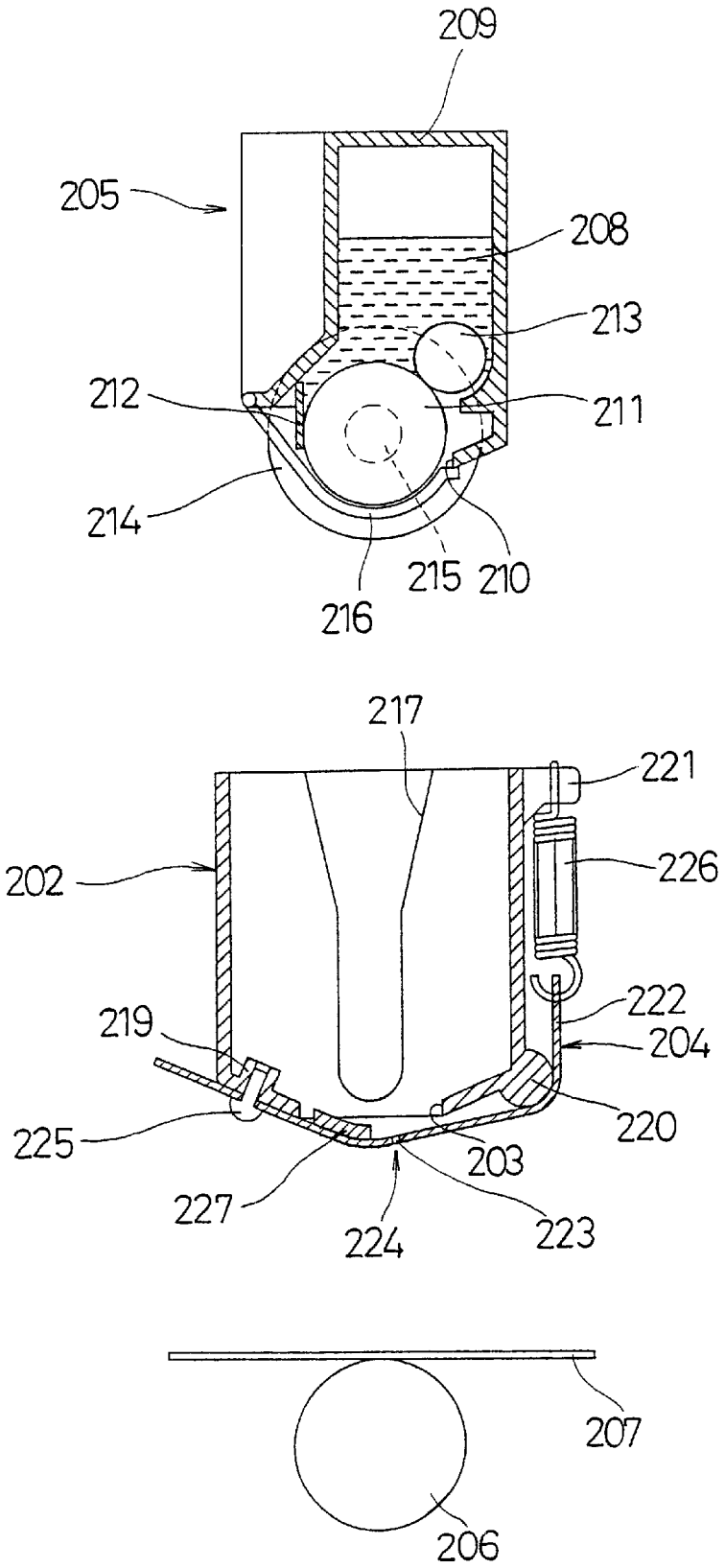
FIG. 17 is an exploded, vertical sectional view showing the image forming apparatus in the embodiment.
Figure 18:
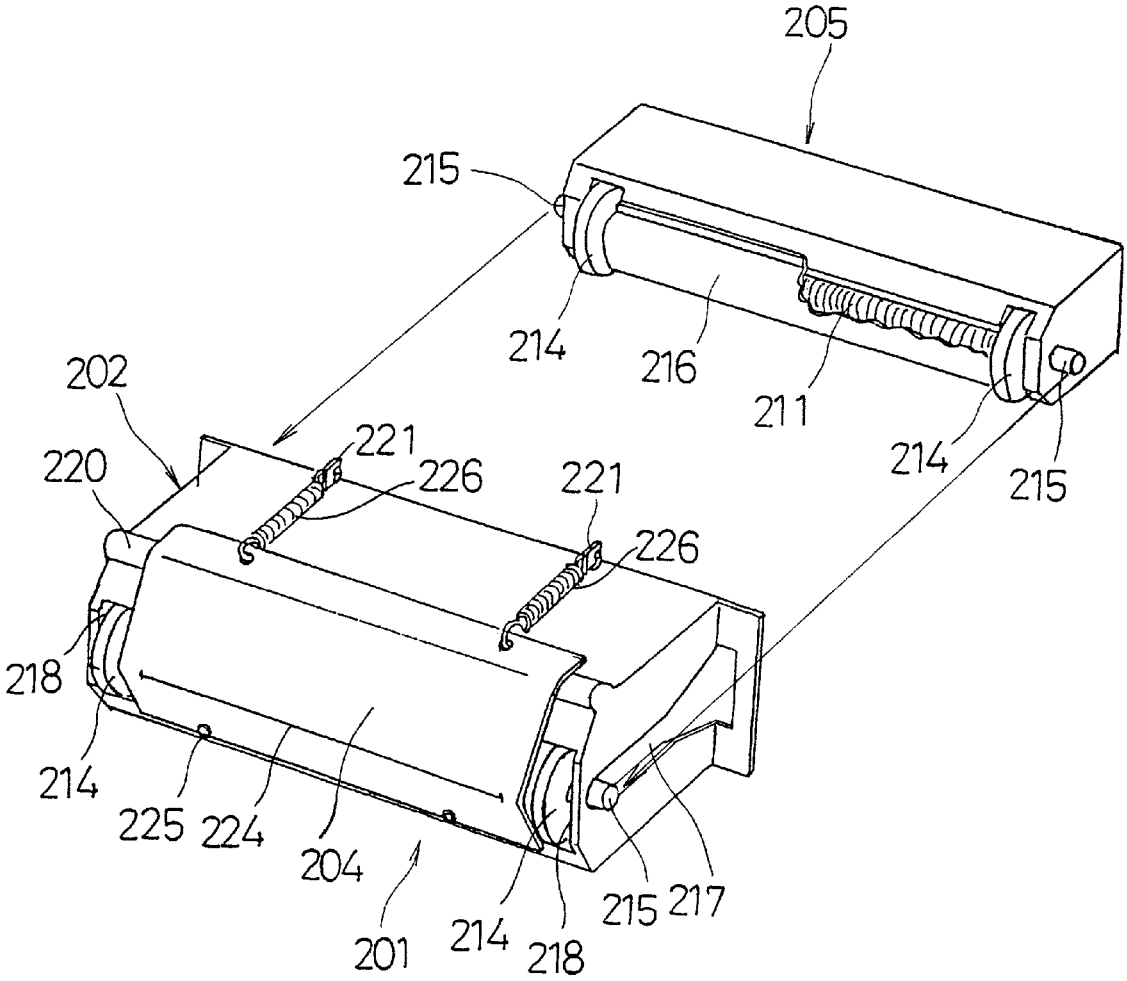
FIG. 18 is a perspective view showing the structure of the print head in the embodiment and the step of mounting a toner cartridge.

In FIGS. 16 to 18 showing the general structure of the image forming apparatus, a print head 201 having a box member 202 with its upper surface being open and a developer supply opening 203 formed at its lower end, developer passing control means 204 provided to cover the developer supply opening 203 at the lower outer surface of the box member 202, and a developer supply unit 205 (hereinafter referred to as "toner cartridge") detachably provided in the box member 202. Back surface electrodes 206 are provided at appropriate intervals at the lower part of the print head 201, and an image receiving member 207 such as recording paper is allowed to pass between the back surface electrode 206 and the print head 201. Note that the back surface electrode 206 is provided at the lower part of the main body case (not shown), and the box member 202 is positioned and secured in a detachable manner at the upper part.

The toner cartridge 205 includes a developer storing container 209 for storing a toner 208 which is a developer, a developing roller 211 serving as developer carrying means provided to face against a developer feeding opening 210 opened in a large range at the lower part of the developer storing container 209, a restriction blade 212 for restricting a toner layer carried and transported by the developing roller 211 to the outside of the developer feeding opening 210, and a supply roller 213 for stirring the toner 208 in the developer storing container 209, thereby charging the toner by friction and supplying the developing roller 211 with the toner 208.

At the outside of both ends of the developing roller 211 in the axial direction, a restriction collar 214 is provided in abutment against the back surface electrode 206 as first spacer means for restricting the distance between the developing roller 211 and the back surface electrode 206 to be constant. The collar has its outer circumferential surface in abutment against the back surface electrode 206 and its inner circumferential surface in abutment against the outer diameter portion of the developing roller 211 or against the outer diameter portion of a coaxial guide shaft 215 extending to both sides from the developing roller 211. The restriction collar 214 may set the distance between the back surface electrode 206 and the developing roller 211 in the range from 150 to 1000 $\mu$m, to 350 $\mu$m according to the embodiment.

Furthermore, the guide shaft 215 coaxial with the developing roller 211 is provided to project from both ends of the developer storing container 209. Reference numeral 216 denotes a protection cover closing the developer feeding opening 210 during the transportation of the toner cartridge 205 to protect the developing roller 211, and the cover is adapted to close automatically.

The toner 208 is held between the developing roller 211 and the restriction blade 212, slightly stirred in the space, and charged with charges received from the developing roller 211. According to the embodiment, the toner 208 is a non-magnetic substance having negative charges of −10 $\mu$C/g and an average grain size of 8 $\mu$m.

The developing roller 211 is made of a metal such as aluminum and iron or an alloy. According to the embodiment, an aluminum tube having an outer diameter of 20 mm and a thickness of 1 mm is used. The restriction blade 212 is made of an elastic material such as urethane and has a hardness in the range from 40° to 80° (measured by the JIS K6301A hardness measurement scale), a free end length (the length of the portion extending from the attachment part) in the range from 5 to 15 mm, and a line pressure on the developing roller 211 in the range from 5 to 40 g/cm. The toner 208 is formed into one to three layers on the developing roller 211. The restriction blade 212 is in an electrically floating state according to the embodiment.

The supply roller 213 is produced by providing synthetic rubber such as urethane foam about as thick as 2 to 6 mm on a metal shaft such as iron (having a diameter of 8 mm according to the embodiment). Appropriately, the hardness is 30° (measured in a roller shape by the JIS K6301A hardness measurement scale), and the roller aids in charging the toner 208 and controls the supply of the toner. The amount of biting to the developing roller 211 is preferably about in the range from 0.1 to 2 mm.

These developing roller 211, restriction blade 212, and supply roller 213 may be electrically grounded or provided with a DC or AC voltage, or the restriction blade 212 may be in an electrically floating state.

The back surface electrode 206 serves as a counter electrode and forms an electric field between the developing roller 211 and itself. The back surface electrode is a metal plate or produced by dispersing a conductive filler within resin. The back surface electrode 206 is provided with a DC voltage about in the range from 500 to 2000V, with 1000V according to the embodiment.

The box member 202 has a guide groove 217 to receive the guide shaft 215 of the toner cartridge 205 inserted at both end walls opposing both ends in the axial direction of the developing roller 211 to position the toner cartridge 205. There is an opening 218 through which the restriction collar 214 penetrates at the outside of both ends of the developer supply opening 203. At one side of the developer supply opening 203 in the box member 202, a securing portion 219 for securing one end of the developer passing control means 204 is formed, a stay portion 220 having a circular cross section for bending the other end of the developer passing control means 204 upward is formed to project at the other side of the developer supply opening 203. There is a pair of spring hooks 221 at an appropriate distance apart at the upper end portion.

The developer passing control means 204 has a single or multiple small hole rows 224 produced by perforating a number of small holes 223 in the insulating base member 222 at a very small pitch in the width-wise direction of the image receiving member 207, a ring-shaped image signal electrode (not shown) surrounding each small hole 223, and a control signal electrode (not shown) at the back surface of the insulating base member 222 so as not to overlap the image signal electrode. The insulating base member 222 is preferably of a material such as polyamide and polyethylene terephthalate, and appropriately has a thickness in the range from 10 to 100 $\mu$m.

According to the embodiment, for the insulating base member 222, polyamide having a thickness of 50 $\mu$m is used. The diameter of the small hole 223 is 145 $\mu$m, and the image signal electrode is in a ring shape having an inner diameter of 150 $\mu$m and an outer diameter of 250 $\mu$m. The control signal electrode has an inner diameter of 250 $\mu$m. A thin resin layer as thin as 1 to 2 $\mu$m is provided on the surface of each electrode. The image signal electrode is made of a foil of metal such as copper having a thickness of about 5 to 30 $\mu$m and independently connected through a lead to an image signal output portion serving as image signal voltage switching means. The image signal electrode is normally provided with a voltage of 400V or less, and according to the embodiment, a voltage of 300V is applied for forming dots, while a voltage of −100V is applied for avoiding forming dots.

One distal end of the developer passing control means 204 is secured to the securing portion 219 of the box member 202 by a securing screw 225. The other distal end is bent by the stay portion 220 and then engaged with the spring hooks 221 through a pair of extension springs 226. A spacer 227 serving as second spacer means is mounted at the inner surface of the developer passing control means 204 on the upstream side of the small hole row 224 in the developer passing control means 204 in the moving direction of the developing roller 211. The toner cartridge 205 is mounted to the box member 202, the restriction collar 214 provided at the developing roller 211 abuts against the back surface electrode 206 and the gap between the developing roller 211 and the back surface electrode 206 is maintained to a prescribed distance. In this state, the outer circumferential surface of the developing roller 211 is in abutment against the spacer 227 and the extension springs 226 suspended at the end of the developer passing control means 204 are displaced by pressing force from the developing roller 211 to the spacer 227. This allows the developer passing control means 204 to be in close contact with the developing roller 211 through the spacer 227 for the entire width. The spacer 227 serves to set the distance between the toner layer on the developing roller 211 and the developer passing control means 204 highly precisely in the range from 0 to 200 $\mu$, to 50 $\mu$m according to the embodiment. Note that the spacer 227 is provided such that the developing roller 211 is in abutment in a position apart from the side edge of the upper surface of the spacer 227 as the toner cartridge 205 is mounted in the box member 202.

Figure 19:
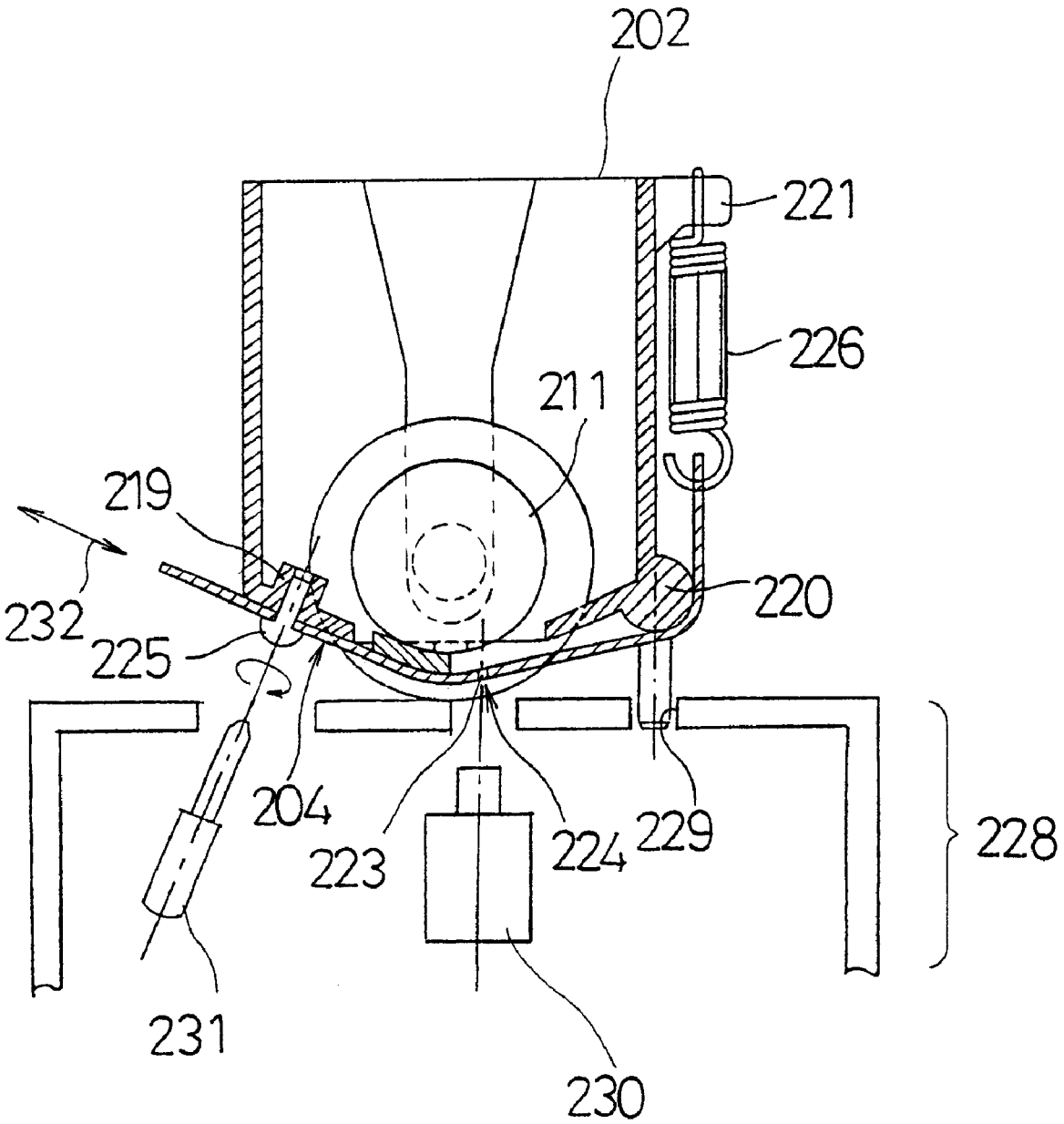
FIG. 19 is a vertical sectional view showing the manufacturing step of positioning and securing developer passing control means according to the embodiment.

As the developer passing control means 204 is mounted to the box member 202 in this manner, the developer passing control means 204 must be positioned and secured highly precisely to the box member 202 so that the small hole row 224 is in prescribed positional relation and parallel to the axis of the developing roller 211. Therefore, the developer passing control means 204 is positioned and secured using a manufacturing device as shown in FIG. 19. In FIG. 19, the manufacturing device 228 includes positioning means 229 for positioning the box member 202 in a prescribed position, a recognition camera 230 for recognizing the position of small holes 223 as images, fastening means 231 for fastening the securing screw 225 to secure one end of the developer passing control means 204 to the box member 202, and position operating means 232 for operating the position of a robot hand or the like used to hold one end of the developer passing control means 204 for positional adjustment. The device has at least one of each element in the width-wise direction.

When the developer passing control means 204 is mounted to the box member 202, the developer passing control means 204 has one end temporarily secured to the securing portion 219 in the box member 202 by the securing screw 225, and the other end engaged with the spring hooks 221 through the extension springs 226, and the box member 202 is positioned by the positioning means 229 and installed at the manufacturing device 228. Then, the developing roller 211 or a dummy thereof is set in a prescribed position of the box member 202, and the developer passing control means 204 is placed in the position restricted by the developing roller 211 when the toner cartridge 205 is mounted. One end of the developer passing control means 204 is held by the position operating means 232 and then the securing screw 225 is unfastened by the fastening means 231. Then, the position of the small holes 223 is recognized as images using the recognition camera 230, so that the position operating means 232 is operated to position the small holes 223 in a prescribed position. Once the small holes 223 are positioned in the prescribed position, the securing screw 225 is fastened by the fastening means 231 to secure the developer passing control means 204. Thus, the developer passing control means 204 is highly precisely positioned and secured to the box member 202. The box member 202 having the developer passing control means 204 thus mounted is provided to be positioned with respect to the back surface electrode 206 in the main body case (not shown) in which the back surface electrode 206 is provided.

In the image forming apparatus having the above structure, when the toner cartridge 205 is mounted, as the protection cover 216 is open as shown in FIG. 16, the guide shaft 215 is guided and engaged with the guide groove 217 to insert the toner cartridge 205 into the box member 202 as shown in FIG. 18 and placed under urging pressing force in a prescribed level or higher by a pressing spring 233 mounted at the lid (not shown) of the main body case as shown in FIG. 16. Then, the engagement of the guide shaft 215 and the guide groove 217 allows the developing roller 211 and the small hole row 224 in the developer passing control means 204 to be positioned parallel in a prescribed positional relation in the horizontal direction in FIG. 16. The abutment of the restriction collar 214 against the back surface electrode 206 sets the gap between the developing roller 211 and the back surface electrode 206 highly precisely to a prescribed value. At the same time, the developing roller 211 abuts against the developer passing control means 204 through the spacer 227 and displaces the developer passing control means 204 under pressure against the urging force of the extension spring 226, and the spacer 227 sets the gap between the developing roller 211 and the developer passing control means 204 highly precisely to a prescribed distance. At the time of forming images, when a electric charge of a prescribed voltage or higher is applied to the image signal electrode in the developer passing control means 204 in response to an externally applied signal, an electric field formed between the developing roller 211 and the back surface electrode 206 is exposed or an accelerated electric field is formed between the developing roller 211 and the image signal electrode. These electric fields directly or indirectly draw the toner 208 toward the back surface electrode 206 and the toner 208 arrives on the image forming member 207. Meanwhile, application of a voltage of a prescribed value or less prevents an electric field from being formed between the developing roller 211 and the back surface electrode 206, so that the toner 208 does not arrive on the image forming member 207. Thus, the arriving toner 208 forms images on the image receiving member 207.

According to the Embodiment C-1, the toner cartridge 205 is detachable from the box member 202, so that the toner 208 can be conveniently supplemented. The toner cartridge 205 is not provided with the developer passing control means 204, and therefore supplement exchange parts can be formed with reduced cost. Simply by mounting the toner cartridge 205 to the box member 202, the developing roller 211, the small hole row 224 in the developer passing control means 204, and the back surface electrode 206 can be positioned highly precisely parallel to one another in any direction, and the gap between them can be set highly precisely to a prescribed distance. As a result, high quality images can be formed.

Since the developing roller 211 is provided in abutment against the spacer 277 from a position apart from the side edge of the upper surface of the spacer 227 as the toner cartridge 205 is mounted to the box member 202. Therefore, the developing roller 211 does not collide against the edge of the spacer 227 and is not damaged. The box member 202 having the developer passing control means 204 is provided to the main body case in a detachable manner, removal of the box member 202 from the main body case allows greater operability in cleaning the small hole row 224 in the developer passing control means 204 and the image receiving means 207. The developer passing control means 204 has its one end detachably secured to the box member 202 and therefore can readily be exchanged and maintained. The protection cover 216 which automatically closes to cover the exposed part of the developing roller 211 when the cartridge 205 is not mounted is provided at the cartridge, and therefore the developing roller 211 can surely be prevented from being damaged during the transportation of the toner cartridge 205.

Figure 20:
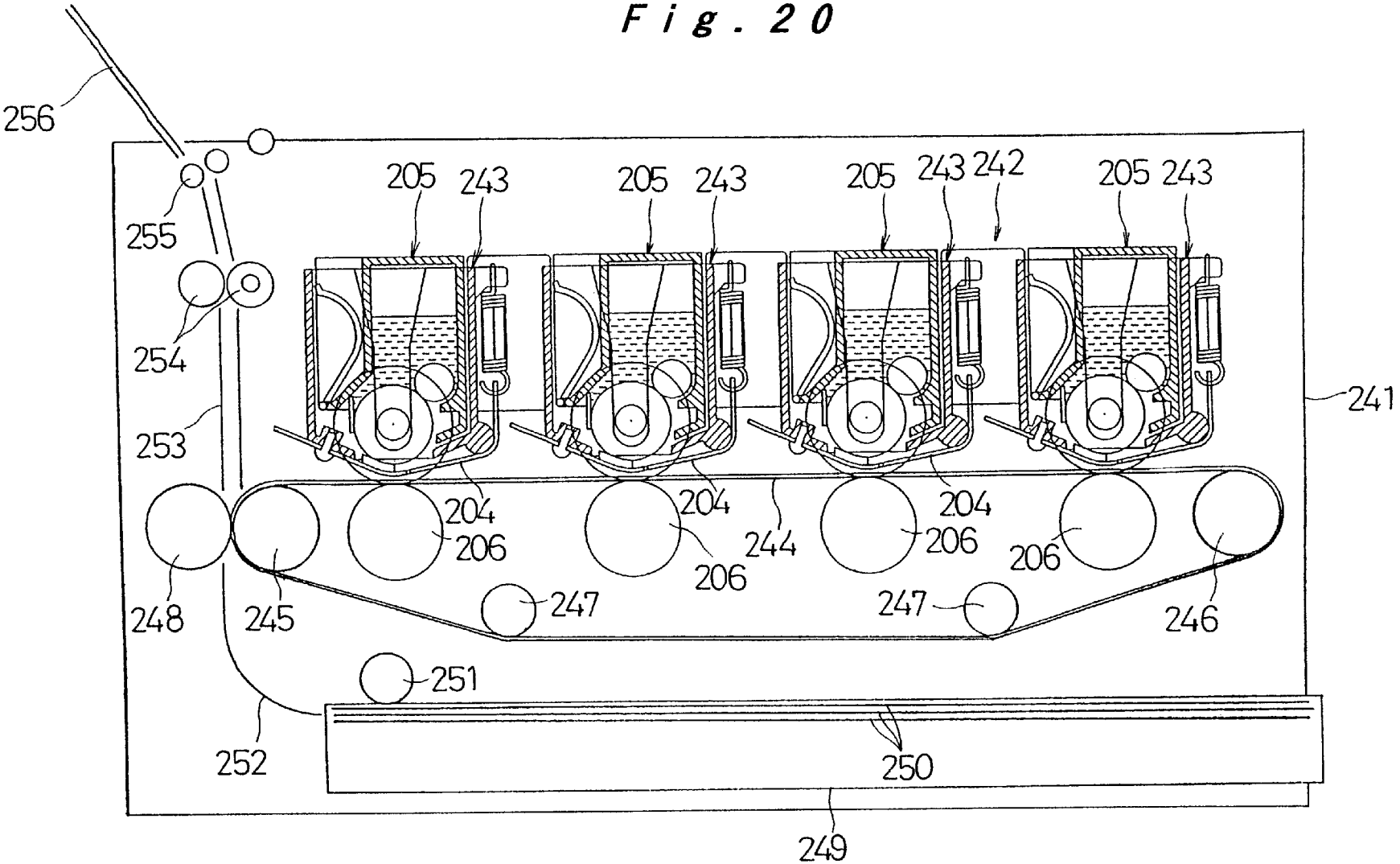
FIG. 20 is a vertical sectional view of an image forming apparatus according to Embodiment C-2 of the present invention.

An image forming apparatus according to another embodiment (referred to as "Embodiment C-2") of the present invention will be now described with reference to FIGS. 20 to 22. The elements the same as those in the Embodiment C-1 are denoted by the same reference numerals and not detailed, and only the different features will be described.

Figure 21:
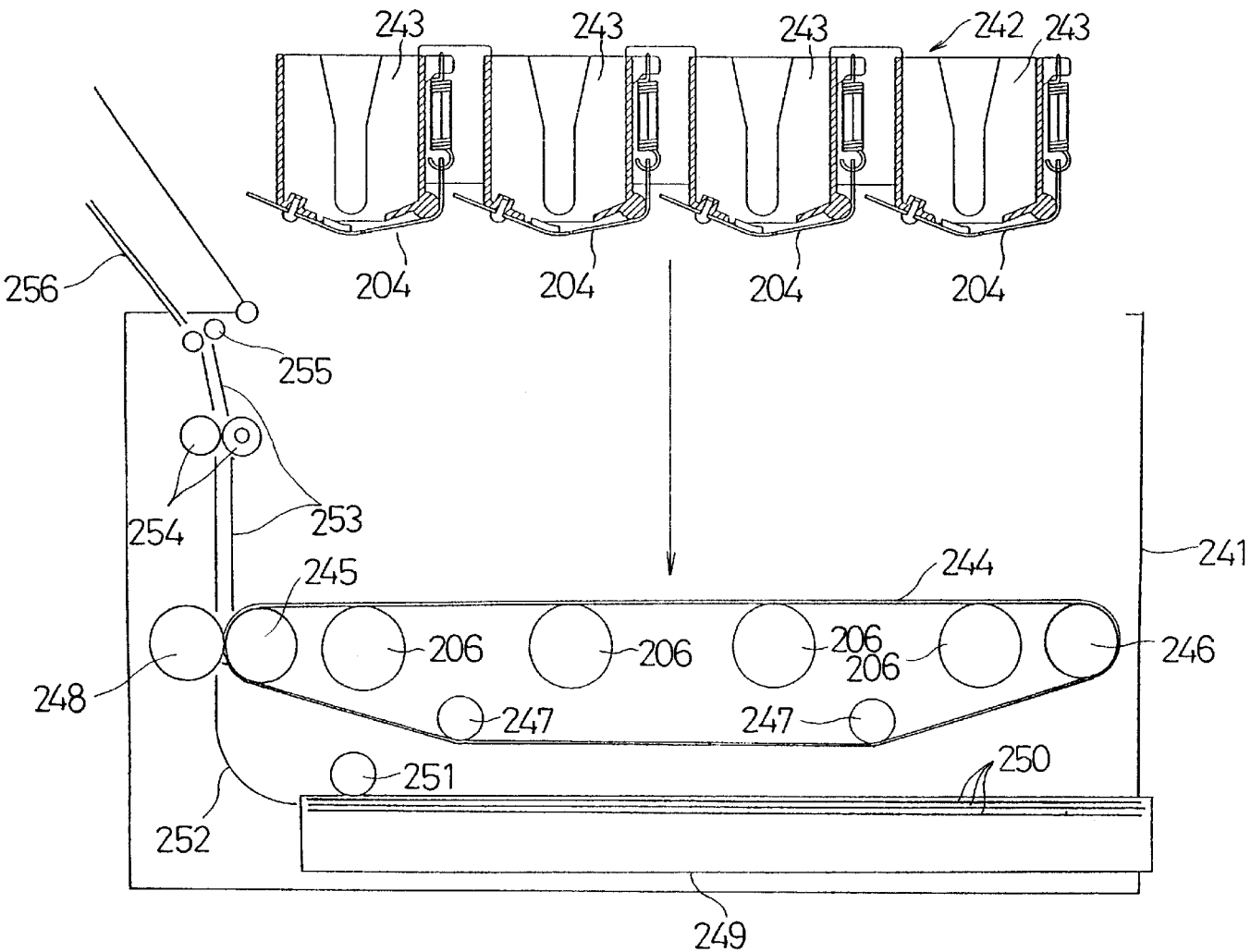
FIG. 21 is a vertical sectional view of the embodiment when a box member is provided.
Figure 22:
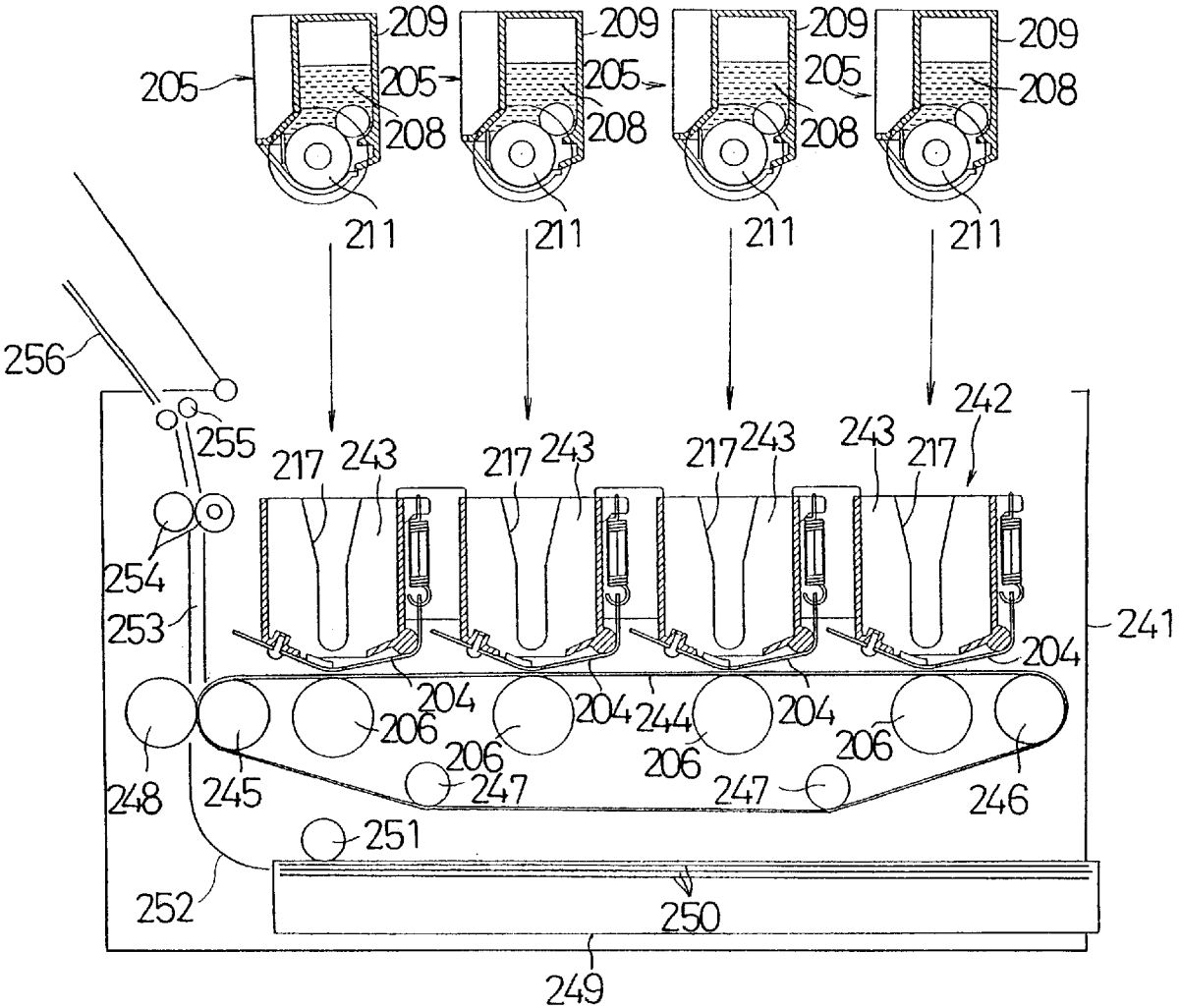
FIG. 22 is a vertical sectional view of the embodiment when a toner cartridge is mounted.

In the image forming apparatus according to the embodiment, a single box member 242 having four box portions 243 for forming color images is detachably provided in a main body case 241 as shown in FIG. 21. Toner cartridges 205 storing developers in four colors are mounted to the box portions 243 as shown in FIG. 22. The box member 242 is formed so that as a toner cartridge 205 is mounted to each box portion 243, the axial centers of the developing rollers 211 are highly precisely parallel to each other. Developer passing control means 204 is provided to each box portion 243 similarly to the above embodiments, and the position of the developer passing control means 204 is separately adjusted so that small hole rows 224 are arranged highly precisely parallel to each other.

At the lower part in the main body case 241, back surface electrodes 206 are each provided in a position under each box portion 243, and an endless intermediate image receiving belt 244 as image receiving means is provided to circulate around sequentially between the developer passing control means 204 mounted to the box portions 243 and the back surface electrodes 206. The axial centers of the back surface electrodes 206 are level and parallel to each other, and also parallel to the axial centers of the developing rollers 211 mounted in the box portions 243. Reference numerals 245 and 246 denote a pair of belt rollers around which the intermediate image receiving belt 244 is wound and 247 denotes a guide roller. A transfer roller 248 for transferring a toner image formed on the surface of the intermediate image receiving belt 244 onto a recording paper sheet 250 is provided opposing one of the belt rollers 245.

Recording paper sheets 250 are layered in a detachable paper feed tray 249 at the lower end of the main body case 241, taken out on a one-sheet-basis by a paper feed roller 251, and supplied to the transfer roller 248 via a paper feed guide 252. The recording paper sheet 250 having toner images transferred from the intermediate image receiving belt 244 is supplied to a fixing roller 254 through a transport guide 253 and discharged onto a discharge tray 256 by a discharge roller 255.

According to the Embodiment C-2, the box member 242 is detachably provided at the main body case 241. Therefore, removal of the box member 242 from the main body case 241 allows easy maintenance for the small hole rows 224 in the developer passing control means 204, the intermediate image receiving belt 244, and the back surface electrodes 206. The box portions 243 having a plurality of toner cartridges 205 are provided to the box member 242, and the developer passing control means 204 are provided so that the small hole rows 224 are arranged parallel to each other at the box portions 243. Therefore, the small hole rows 224 in the developer passing control means 204 and the developing rollers 211 in the toner cartridge 205 can be positioned parallel in the single box member 242, and high quality color images can be formed. The developer passing control means 204 is secured so as to be independently positioned to each box portion 243 by the manufacturing device and the manufacturing method in FIG. 19. Therefore, the small hole rows 224 can be set highly precisely parallel by individual adjustment of each developer passing control means 204, so that misalignment among colors can surely be prevented and high quality color images can be formed. Each developer passing control means 204 can readily be exchanged and maintained.

When a plurality of toner cartridges 205 are mounted to the box member 202, the restriction rollers 214 provided to the developing rollers 211 in the toner cartridges 205 directly abut against the opposing back surface electrodes 206, respectively. As a result, without the effect of fine distortion or curve in the box member 202 if any, the distance between the developing roller 211 and the back surface electrode 206 can independently be restricted to the opposing back surface electrode 206 highly precisely and stably for each toner cartridge 205. Consequently, the recording conditions can be equalized for the plurality of toner cartridges 205, and high quality color image in good color balance can be formed.

INDUSTRIAL APPLICABILITY

By an image forming apparatus according to the present invention, as can be understood from the foregoing description, the fluctuation of the toner passing control means generated by the friction at the contact point between the toner passing control means and the moving toner carrier can be prevented, the positional fluctuation of the toner passing holes can be prevented and high quality images can be formed.

Corrugation deformation caused at the toner passing control means can be prevented or the gap can be prevented from being formed between the spacer and the toner carrier. The distance between the toner carrier and the toner passing control means can be constant in the direction of the toner passing hole row and the toner amount passing through each toner passing hole is equalized, and high quality images can be formed.

After the toner passed through the toner passing holes in the toner passing control means flies and sticks onto the image receiving means, the toner can be prevented from returning to the toner passing control means from the image receiving means, so that spotless, high quality images can be formed.

Furthermore, by the image forming apparatus according to the present invention, ultrasonic vibration can surely be transmitted if the developer passing control means is somewhat displaced, stable cleaning performance is achieved, images can be formed stably and without the possibility of distortion at the developer passing control means, and high quality images can be formed.

In addition, by the image forming apparatus according to the present invention, the developer passing control means can supplement a developer by removing the developer supply unit to the positioned and secured box member, which makes the apparatus easy to be handled. The developer supply unit as a supply exchange part is not provided with the developer passing control means, which reduces the cost. The developer supply unit is positioned to the box member and therefore high quality images can be formed, so that the image forming apparatus according to the present invention is useful in forming high quality images and for the readiness in handling.

What is claimed is:

1. An image forming apparatus, comprising: a toner carrier moving while carrying a charged toner; toner passing control means having a plurality of toner passing holes through which the toner passes and applying an image signal to a control electrode provided to surround the holes, thereby controlling passage of the toner; image receiving means to which the passed toner sticks; and a back surface electrode provided at a back surface of the image receiving means for drawing the toner, wherein the toner passing control means is secured on an upstream side of a contact point with the toner carrier in a moving direction of the toner carrier, and is secured on a downstream side in the moving direction of the toner carrier through an elastic member.

2. An image forming apparatus, comprising: a toner carrier moving while carrying a charged toner; toner passing control means having a plurality of toner passing holes through which the toner passes and applying an image signal to a control electrode provided to surround the holes, thereby controlling passage of the toner; image receiving means to which the passed toner sticks; and a back surface electrode provided at the back surface of the image receiving means for drawing the toner, wherein the toner passing control means is in contact with a stay extending perpendicularly to a moving direction of the toner carrier on the downstream side of the contact point with the toner carrier in the moving direction of the toner carrier.

3. An image forming apparatus, comprising: a toner carrier moving while carrying a charged toner; toner passing control means having a plurality of toner passing holes through which the toner passes and applying an image signal to a control electrode provided to surround the holes, thereby controlling passage of the toner; image receiving means to which the passed toner sticks; and a back surface electrode provided at the back surface of the image receiving means for drawing the toner, wherein the toner passing holes are contacted with said toner carrier through spacer means provided in a position on the toner passing control means on an upstream side of the toner passing holes in a moving direction of the toner carrier, the toner passing control means is contacted to a stay extending in a direction perpendicular to the moving direction of the toner carrier on a downstream side of a contact point with the toner carrier in the moving direction of the toner carrier.

4. An image forming apparatus, comprising: a toner carrier moving while carrying a charged toner; toner passing control means having a plurality of toner passing holes through which the toner passes and applying an image signal to a control electrode provided to surround the holes, thereby controlling passage of the toner; image receiving means to which the passed toner sticks; and a back surface electrode provided at the back surface of the image receiving means for drawing the toner, wherein a gap portion is provided between the toner passing control means and the image receiving means gradually expanding toward a downstream side of the image receiving means from the toner passing holes.

5. An image forming apparatus, comprising: developer carrying means for carrying and transporting a charged developer; developer passing control means having a base member provided with a row of a plurality of small holes through which the developer passes in a direction perpendicular to a direction of transporting the developer and controlling passage of the developer through the small holes in response to an externally applied image signal; and image receiving means to which the developer passed through the small holes sticks, wherein a vibrating member is rigidly attached to a side portion of the base member of the developer passing control means in a direction of arranging the small holes, ultrasonic vibration generating means for generating ultrasonic vibration is provided, the ultrasonic vibration means and the vibrating member are coupled by coupling means allowing relative displacement between them and transmitting ultrasonic vibration.

6. The image forming apparatus according to claim 5, wherein vibrating member is provided with a coupling portion integrally extending toward the ultrasonic vibration generating means at one end, the coupling plate portion has its tip end secured to the ultrasonic vibration generating means and the coupling plate portion is provided with a width-reduced portion.

7. The image forming apparatus according to claim 5, wherein the vibrating member is provided with a coupling plate portion integrally extending toward the ultrasonic vibration generating means at one end, the coupling plate portion has its tip end secured to the ultrasonic vibration generating means and the coupling plate portion is provided with a bent portion.

8. The image forming apparatus according to claim 5, wherein the vibrating member has a coupling plate portion integrally extending toward the ultrasonic vibration generating means at one end, the coupling plate portion has its tip end secured to the ultrasonic vibration generating means, and the coupling plate portion is provided with a U-shaped portion.

9. The image forming apparatus according to claim 5, wherein the developer passing control means has one end of the base member on an upstream side in the developer transporting direction secured, and the other end coupled to extension means, and the developer carrying means and the developer passing control means are partly in direct or indirect contact to set a gap between them.

10. The image forming apparatus according to claim 9, wherein the vibrating member is provided in a position on a downstream side of a position of arranging a small hole row in the developer passing control means in the direction of transporting the developer, and the base member of the developer passing control means is bent by the vibrating member.

11. An image forming apparatus, comprising: developer carrying means for carrying and transporting a charged developer; developer passing control means having a base member provided with a row of a plurality of small holes through which the developer passes in a direction perpendicular to a direction of transporting the developer and controlling passage of the developer through the small holes in response to an externally applied image signal; and image receiving means to which the developer passed through the small holes sticks, wherein a vibrating member is rigidly attached to a side portion of the base member of the developer passing control means in a direction of arranging the small holes, ultrasonic vibration generating means for generating ultrasonic vibration is provided, the vibrating member and the ultrasonic vibration generating means are rigidly coupled, and the ultrasonic vibration generating means is supported in a displaceable manner.

12. The image forming apparatus according to claim 5 or 11, wherein the developer passing control means has one end of the base member secured on a downstream side in the direction of transporting the developer and the other end coupled to extension means, and the developer carrying means and the developer passing control means are partly in direct or indirect contact to set the gap between them.

13. The image forming apparatus according to claim 5 or 11, wherein the vibrating members is provided on the developer passing control means on an opposite side of a position where the developer carrying means and the developer passing control means are partly in direct or indirect contact in the direction of transporting the developer with reference to a small hole row.

14. The image forming apparatus according to claim 11, wherein the vibrating member is supported rotatably around its axial center, and the ultrasonic vibration generating means is supported pivotally around the same axis.

15. An image forming apparatus, comprising: developer carrying means carrying and transporting a charged developer; developer passing control means having a base member provided with a row of a plurality of small holes through which the developer passes in a direction perpendicular to a direction of transporting the developer and controlling passage of the developer through the small holes in response to an externally applied image signal; and image receiving means to which the developer passed through the small holes sticks, wherein a vibrating member is rigidly attached to a side portion of the base member of the developer passing control means in a direction of arranging the small holes, the vibrating member is supported rotatably around its axial center, ultrasonic vibration generating means for generating ultrasonic vibration is provided, a coupling vibrating member rigidly coupled to the ultrasonic vibration generating means and the vibrating member are coupled in a relatively rotatable manner.

16. The image forming apparatus according to claim 15, wherein the developer passing control means has the base member having one end, on its upstream side in the direction of transporting the developer, secured and the other end coupled to extension means, and the base member of the developer passing control means is bent by the vibrating member.

17. An image forming apparatus, comprising: developer carrying means carrying and transporting a charged developer; developer passing control means having a base member provided with a row of a plurality of small holes through which the developer passes in a direction perpendicular to a direction of transporting the developer and controlling passage of the developer through the small holes in response to an externally applied image signal; image receiving means to which the developer passed through the small holes sticks; and ultrasonic cleaning means for providing ultrasonic vibration to the developer passing control means, thereby cleaning the small holes, wherein a seal blade is attached at a developer storing container wall or at a case wall storing a developer storing container, said seal blade having a tip end in contact with an inner surface in a position on an opposite side of a position where the developer carrying means and the developer passing control means are in direct or indirect contact in the direction of transporting the developer with reference to a small hole row in the developer passing control means.

18. An image forming apparatus, comprising: developer carrying means for carrying and transporting a charged developer; developer passing control means having a base member provided with a row of a plurality of small holes in a direction perpendicular to a direction of transporting the developer through which the developer passes and controlling passage of the developer through the small holes in response to an externally applied image signal; image receiving means to which the developer passed through the small holes sticks; and a back surface electrode supporting the image receiving means and provided with a prescribed voltage for forming an electric field between the developer carrying means and itself to let the developer fly, wherein a developer supply unit is composed by integrating the developer carrying means and a storing container storing the developer, and at least one end of the developer passing control means being positioned and secured to a box member having the developer supply unit provided in a detachable manner.

19. The image forming apparatus according to claim 18, wherein one end of the developer passing control means is positioned and secured to the box member, and the other end of the developer passing control means is coupled to extension means.

20. The image forming apparatus according to claim 19, wherein second spacer means is provided on an inner side of the developer passing control means, said second spacer means abutting against the developer carrying means when the developer supply unit is mounted to the box member.

21. The image forming apparatus according to claim 20, wherein the developer passing control means abuts through the second spacer means or directly against the developer carrying means when the developer supply unit is mounted to the box member, so that the developer passing control means is moved and the extension means is displaced.

22. The image forming apparatus according to claim 20, wherein, when the developer supply unit is mounted to the box member, the developer carrying means is in abutment in a position apart from a side edge of the upper surface of the second spacer means.

23. The image forming apparatus according to claim 19, wherein the developer passing control means has one end detachably secured to the box member.

24. The image forming apparatus according to claim 18, wherein a guide shaft is provided to project at both ends of the developer supply unit, a guide groove with which the guide shaft engages when the developer supply unit is inserted to the box member is provided, and the engagement of the guide shaft and the guide groove positions a small hole row in the developer passing control means and the developer carrying means in a plane direction perpendicular to a far-near direction of its axial center.

25. The image forming apparatus according to claim 18, wherein the developer supply unit is provided with first spacer means for abutting against the back surface electrode and restricting the distance between the developer carrying means and the back surface electrode when the unit is mounted to the box member.

26. The image forming apparatus according to claim 25 or 20, further comprising means for pressing and urging the developer supply unit toward the back surface electrode and the developer passing control means as the developer supply unit is mounted.

27. The image forming apparatus according to claim 18, wherein the developer supply unit has a protection cover for covering an exposed part of the developer carrying means when it is not mounted.

28. The image forming apparatus according to claim 18, wherein the box member is detachably provided to a main body case.

29. The image forming apparatus according to claim 28, wherein the box member is detachably provided to the main body case so as to be positioned with respect to the back surface electrode.

30. The image forming apparatus according to claim 28, further comprising a plurality of back surface electrodes, a plurality of box members being detachably provided to the main body case so as to be each independently positioned with respect to an opposing back surface electrode.

31. The image forming apparatus according to claim 18, wherein a mounting portion for a plurality of developer supply units and the developer passing control means are provided parallel to each other at the box member.

32. The image forming apparatus according to claim 31, wherein the developer passing control means are secured so that they can be each independently positioned.

33. The image forming apparatus according to claim 32, wherein the developer passing control means is positioned at the box member so that the small hole rows in the developer passing control means are parallel to each other.

34. The image forming apparatus according to claim 31, wherein, when a plurality of developer supply units are mounted to the box member, a first spacer provided at each developer supply unit abuts against an opposing back surface electrode, so that the distance between the developer carrying means and the back surface electrode is independently restricted with respect to the opposing back surface electrode for each developer supply unit.

35. A method of manufacturing an image forming apparatus, said apparatus comprising: developer carrying means for carrying and transporting a charged developer; and developer passing control means having a base member provided with a row of a plurality of small holes through which the developer passes in a direction perpendicular to a direction of transporting the developer and controlling passage of the developer through the small holes in response to an externally applied image signal, a developer carrier being detachably mounted to a box member, the developer passing control means having one end secured to the box member and the other end coupled to an extension member, said method comprising the steps of: positioning and securing the box member temporarily provided with the developer passing control means in a prescribed position; mounting the developer carrying means or a dummy thereof in a prescribed position of the box member; holding one end of the developer passing control means against an urging force of the extension member while recognizing the position of a small hole row, and adjusting the position of the small hole row to be in a prescribed position; and securing one end of the developer passing control means to the box member.

36. A device for manufacturing an image forming apparatus, said image forming apparatus comprising: developer carrying means for carrying and transporting a charged developer; and developer passing control means having a base member provided with a row of a plurality of holes through which the developer passes in a direction perpendicular to a direction of transporting the developer and controlling passage of the developer through the small holes in response to an externally applied image signal, a developer carrier being detachably mounted to the box member, the developer passing control means having one end secured to the box member and the other end coupled to an extension member, said manufacturing device including: means for positioning and securing the box member in a prescribed position; means for mounting the developer carrying means or a dummy thereof in a prescribed position of the box member; means for recognizing the position of a small hole row; means for holding one end of the developer passing control means and performing positional adjustment; and means for securing one end of the developer passing control means to the box member.

* * * * *